US009608346B2

(12) United States Patent
Melni

(10) Patent No.: US 9,608,346 B2
(45) Date of Patent: Mar. 28, 2017

(54) MECHANICAL AND/OR ELECTRICAL CONNECTOR WITH AXIAL-PULL APPARATUS AND METHODS

(71) Applicant: Mark L. Melni, Twin Falls, ID (US)

(72) Inventor: Mark L. Melni, Twin Falls, ID (US)

(73) Assignee: MELNI, LLC, Twin Falls, ID (US)

( * ) Notice: Subject to any disclaimer, the term of this patent is extended or adjusted under 35 U.S.C. 154(b) by 24 days.

(21) Appl. No.: 14/571,284

(22) Filed: Dec. 15, 2014

(65) Prior Publication Data

US 2015/0200471 A1 Jul. 16, 2015

Related U.S. Application Data

(63) Continuation of application No. 13/591,216, filed on Aug. 21, 2012, now Pat. No. 8,771,000, which is a (Continued)

(51) Int. Cl.
*H01R 13/52* (2006.01)
*H01R 11/28* (2006.01)
(Continued)

(52) U.S. Cl.
CPC ..... *H01R 11/28* (2013.01); *H01R 4/12* (2013.01); *H01R 4/489* (2013.01);
(Continued)

(58) Field of Classification Search
CPC ..... H01R 11/28; H01R 4/4872; H01R 4/489; H01R 4/12; H01R 13/5205; H01R 13/22;
(Continued)

(56) References Cited

U.S. PATENT DOCUMENTS 9,369 A 11/1852 Richards
254,559 A 3/1882 Lothrop
(Continued)

FOREIGN PATENT DOCUMENTS

CA 2779248 A1 11/2014
DE 10253887 A1 6/2004
(Continued)

OTHER PUBLICATIONS

Examples of Polaris™ Block Electrical Connectors, http://www.polarisconnectors.com, available prior to Nov. 3, 2009.
(Continued)

*Primary Examiner* — Jean F Duverne
(74) *Attorney, Agent, or Firm* — Pedersen and Company, PLLC; Ken J. Pedersen; Barbara S. Pedersen

(57) ABSTRACT

A mechanical and/or electrical connector grips onto one or more members inside a hollow passageway of a spiral connector by means of the spiral, or a portion of the spiral being pulled axially to elongate the spiral/spiral-portion, which consequently reduces the diameter of the passageway. The reduction in the diameter of the passageway causes the spiral/spiral-portion to tighten/squeeze/grip on or around the member(s) inside the passageway, to retain the member(s) inside the passageway. Thus, the spiral/spiral-portion mechanically connects the inserted member(s) to each other and/or to another object to which the spiral/spiral-portion is mechanically connected. For example, members inserted into opposite ends of the passageway, or multiple members inserted together into one end of the passageway, will be mechanically connected. The spiral/spiral-portion may be used to mechanically connect one or more members inserted into one, or optionally two ends of the passageway, to a fastener that is connected to or fixed to another object, for example, a construction or other utilitarian element. Adjust-
(Continued)

ment systems may be included to length, shorten, pivot or swing portions of the connector for improved orientation and/or tension of connect members.

20 Claims, 25 Drawing Sheets

Related U.S. Application Data continuation-in-part of application No. 13/306,653, filed on Nov. 29, 2011, now Pat. No. 8,246,370, which is a continuation of application No. 12/939,148, filed on Nov. 3, 2010, now Pat. No. 8,066,525, which is a continuation-in-part of application No. 12/871,819, filed on Aug. 30, 2010, now Pat. No. 7,901,233, said application No. 12/871,819 is a continuation of application No. 12/391,247, filed on Feb. 23, 2009, now Pat. No. 7,794,255, application No. 14/571,284, which is a continuation-in-part of application No. 14/326,422, filed on Jul. 8, 2014.

(60) Provisional application No. 61/257,827, filed on Nov. 3, 2006, provisional application No. 61/030,470, filed on Feb. 21, 2008, provisional application No. 61/054,770, filed on May 20, 2008, provisional application No. 61/100,768, filed on Sep. 29, 2008, provisional application No. 61/106,473, filed on Oct. 17, 2008, provisional application No. 61/916,285, filed on Dec. 15, 2013, provisional application No. 62/080,732, filed on Nov. 17, 2014.

(51) Int. Cl.

| | |
|---|---|
| ***H01R 4/56*** | (2006.01) |
| ***H01R 9/11*** | (2006.01) |
| ***H01R 11/11*** | (2006.01) |
| ***H01R 11/12*** | (2006.01) |
| ***H01R 13/22*** | (2006.01) |
| ***H01R 4/12*** | (2006.01) |
| ***H01R 4/48*** | (2006.01) |

(52) U.S. Cl.

CPC ..... *H01R 4/4872* (2013.01); *H01R 4/56* (2013.01); *H01R 9/11* (2013.01); *H01R 11/11* (2013.01); *H01R 11/12* (2013.01); *H01R 13/22* (2013.01); *H01R 13/5205* (2013.01); *Y10T 29/49204* (2015.01)

(58) Field of Classification Search

CPC ..... H01R 9/11; H01R 11/11; H01R 11/12; H01R 4/46; H01R 9/0525; H01R 9/0521; H01R 9/03; Y10T 29/49204

USPC ..... 439/271

See application file for complete search history.

(56) References Cited

U.S. PATENT DOCUMENTS

| | | | | |
|---|---|---|---|---|
| 1,039,542 | A | 9/1912 | Kennington | |
| 1,649,923 | A | 11/1927 | Post | |
| 1,657,253 | A | 1/1928 | Fortin | |
| 1,858,816 | A | 5/1932 | Burkhardt | |
| 2,093,810 | A | 9/1937 | Karmazin | |
| 2,434,358 | A | 1/1948 | Frank | |
| 2,521,722 | A | 9/1950 | Hubbell et al. | |
| 2,724,097 | A | 11/1955 | Matthysse | |
| 2,724,736 | A | 11/1955 | Klumpp | |
| 2,792,560 | A | 5/1957 | Bollmeier | |
| 3,032,737 | A | 5/1962 | Rottmann | |
| 3,107,966 | A | 10/1963 | Bonhomme | |
| 3,110,755 | A | 11/1963 | Esser | |
| 3,206,833 | A | 9/1965 | Yonkers | |
| 3,497,607 | A | 2/1970 | Swanson | |
| 4,035,577 | A | 7/1977 | Loeber | |
| 4,087,157 | A | 5/1978 | Hodges | |
| 4,104,482 | A | 8/1978 | Scott | |
| 4,192,567 | A | 3/1980 | Gomolka | |
| 4,199,211 | A | 4/1980 | Kidder | |
| 4,268,104 | A | 5/1981 | Kidder | |
| 4,531,016 | A | 7/1985 | Duve | |
| 4,632,488 | A | 12/1986 | Long et al. | |
| 4,632,496 | A | 12/1986 | Williams | |
| 4,707,567 | A | 11/1987 | Blaha | |
| 4,740,656 | A | 4/1988 | Rich | |
| 4,803,779 | A | 2/1989 | Blaha | |
| 4,886,074 | A | 12/1989 | Bisping | |
| 4,924,035 | A | 5/1990 | Miller et al. | |
| 4,944,699 | A | 7/1990 | Velke et al. | |
| 5,018,251 | A | 5/1991 | Brown | |
| 5,228,875 | A | 7/1993 | Swenson | |
| 5,252,779 | A | 10/1993 | DiRienzo | |
| 5,259,395 | A | 11/1993 | Li | |
| 5,260,515 | A | 11/1993 | Braun | |
| 5,331,113 | A | 7/1994 | Soni et al. | |
| 5,418,331 | A | 5/1995 | Delalle | |
| 5,435,296 | A | 7/1995 | Vivenzio et al. | |
| 5,683,273 | A | 11/1997 | Garver et al. | |
| 5,695,369 | A | 12/1997 | Swenson | |
| 5,881,435 | A | 3/1999 | Jermyn | |
| 5,925,853 | A | 7/1999 | Miller | |
| 5,975,939 | A | 11/1999 | Market | |
| 6,034,325 | A * | 3/2000 | Nattel | H01R 9/03 174/59 |
| 6,179,387 | B1 | 1/2001 | Nasset et al. | |
| 6,206,736 | B1 | 3/2001 | DeFrance et al. | |
| 6,358,103 | B1 | 3/2002 | Tomasino | |
| 6,443,756 | B1 | 9/2002 | Hagmann et al. | |
| 6,471,554 | B2 | 10/2002 | Armistead et al. | |
| 6,494,753 | B1 | 12/2002 | Tomasino | |
| 6,530,126 | B2 | 3/2003 | Caveney et al. | |
| 6,570,094 | B2 | 5/2003 | King | |
| D478,555 | S | 8/2003 | Tomasino | |
| 6,692,313 | B1 | 2/2004 | Tomasino | |
| 6,695,653 | B1 | 2/2004 | Tomasino | |
| 6,733,336 | B1 * | 5/2004 | Montena | H01R 9/0524 439/578 |
| 6,773,312 | B2 | 8/2004 | Bauer et al. | |
| 6,814,630 | B1 | 11/2004 | Tomasino | |
| 6,830,491 | B1 | 12/2004 | Tomasino | |
| 6,851,966 | B1 | 2/2005 | Tomasino | |
| 6,866,550 | B1 | 3/2005 | Tomasino | |
| 6,878,880 | B2 | 4/2005 | King | |
| 6,914,191 | B2 | 7/2005 | Leith et al. | |
| 7,086,150 | B2 | 8/2006 | King et al. | |
| 7,794,255 | B2 | 9/2010 | Melni | |
| 7,901,233 | B2 | 3/2011 | Melni | |
| 8,066,525 | B2 | 11/2011 | Melni | |
| 8,246,370 | B2 | 8/2012 | Melni | |
| 8,641,446 | B1 * | 2/2014 | Chen | H01R 24/52 439/141 |
| 8,727,807 | B2 * | 5/2014 | Sykes | H01R 9/0521 439/578 |
| 8,771,000 | B2 | 7/2014 | Melni | |
| 2005/0045362 | A1 | 3/2005 | King et al. | |
| 2006/0042079 | A1 | 3/2006 | King et al. | |
| 2008/0023224 | A1 | 1/2008 | Gumley | |
| 2009/0233482 | A1 * | 9/2009 | Chawgo | H01R 9/0524 439/578 |
| 2015/0079852 | A1 | 3/2015 | Melni | |

FOREIGN PATENT DOCUMENTS

| | | | |
|---|---|---|---|
| GB | 820899 | A | 9/1959 |
| WO | WO2009105784 | A2 | 8/2009 |
| WO | WO2011056901 | A2 | 5/2011 |
| WO | 2015/089513 | A1 | 6/2015 |

(56) References Cited

FOREIGN PATENT DOCUMENTS

OTHER PUBLICATIONS

Tuff-Seal™ Strain Relief Cord Connectors, http://www.remke.com/products/strain-relief-cord-connectors.php, pp. 1-3, available at least as early as Jul. 2012.
PCT International Search Report, PCT/US2009/034928, Sep. 30, 2009, Applicant: Melni.
PCT Written Opinion, PCT/US2009/034928, Sep. 30, 2009, Applicant: Melni.
PCT International Search Report and the Written Opinion, PCT/US2010/055337, Jul. 13, 2011, Applicant: Melni.
Supplementary European Search Report, Application No. EP 09 71 1835, derived from PCT/US2009/034928, Applicant: Melni, date of completion: Aug. 5, 2013.
Supplementary European Search Report, Application No. EP 10 82 9047, derived from PCT/US2010/055337, Applicant: Melni, date of completion: Jun. 17, 2014.
PCT International Search Report, PCT/US2014/070422, date of mailing: Apr. 15, 2015, applicant: Melni.
PCT Written Opinion of the International Searching Authority, PCT/US2014/070422, date of mailing: Apr. 15, 2015, applicant: Melni.

* cited by examiner

200

200

200

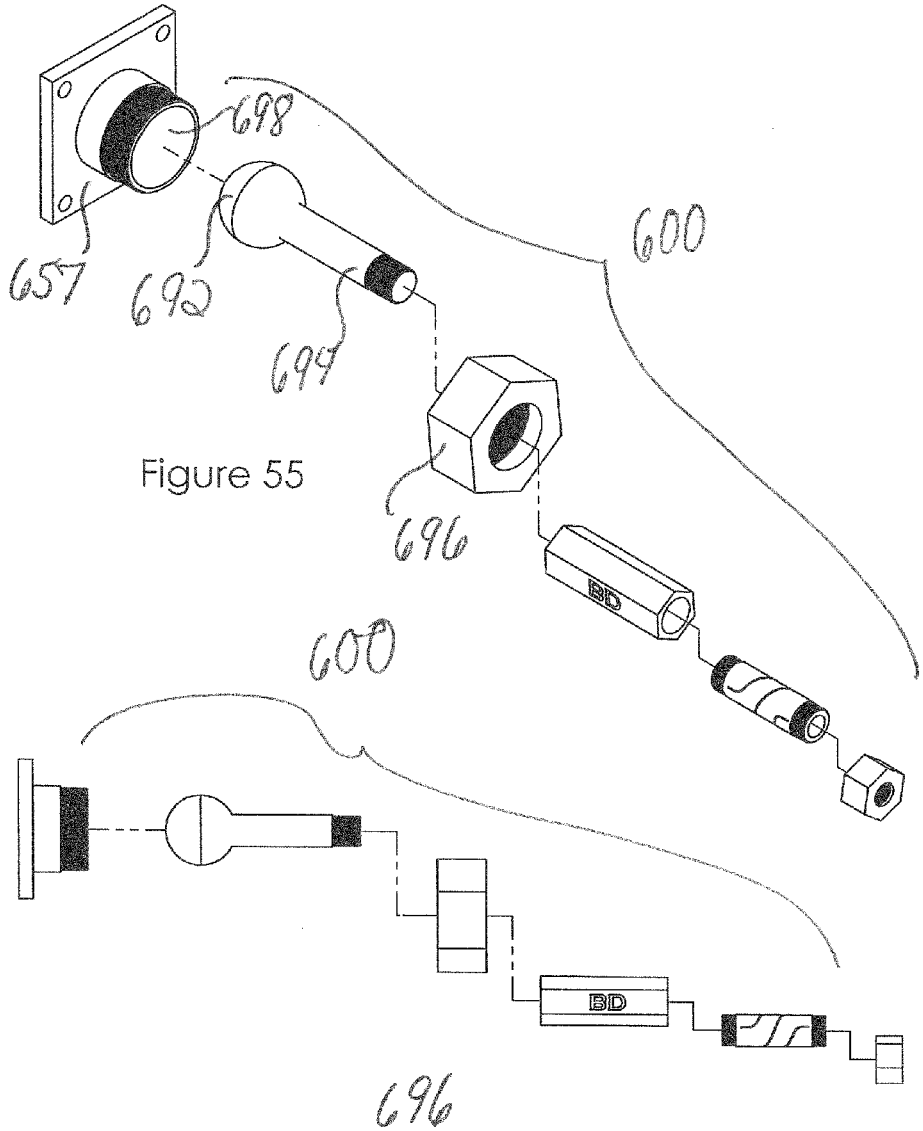
Figure 55
Figure 56
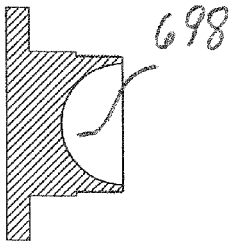
Figure 57
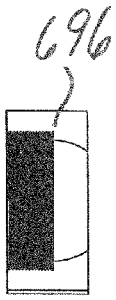
Figure 58

MECHANICAL AND/OR ELECTRICAL CONNECTOR WITH AXIAL-PULL APPARATUS AND METHODS

This application claims priority of U.S. Provisional Application Ser. No. 61/916,285, filed Dec. 15, 2013, and Ser. No. 62/080,732, filed Nov. 17, 2014, the disclosures of which are incorporated herein in their entirety by this reference.

FIELD OF THE INVENTION

The invention relates generally to mechanical and/or electrical connectors. More specifically, the inventor relates to a connector, or a combination of connectors, that mechanically connect, and optionally electrically connect, members inserted into the connector(s). The members being connected will reside in and be gripped/squeezed by the wall(s) of an elongated passageway(s) of the connector(s). The connector(s) preferably does/do not include a conventional set-screw or set-bolt connection or a crimp electrical connection, and, instead, utilize axial pulling, and the resulting movement, of a spiral to tighten the coils of the spiral around the members being connected.

In certain versions, the connectors are used to mechanically connect multiple elongated members to each other, or one or more elongated members to another object, such as a wall, tower, or other construction or utility object. In certain of the mechanical connection embodiments, the elongated member(s) and the connector, and the other object, if any, may consist of or comprise electrically-conductive materials/components, so that the mechanical connection also results in electrical connection.

SUMMARY

The invention comprises a mechanical and/or electrical connector and/or methods of making or using same. The connector grips onto one or more members inside a hollow passageway of the connector by means of the connector, or a portion of the connector, being pulled axially to elongate the connector/connector-portion, which consequently reduces the diameter of the passageway. Thus, certain embodiments of the connector may be called an "axial-pull" connector. The reduction in the diameter of the passageway causes the connector/connector-portion to tighten/squeeze/grip on or around the member(s) inside the passageway, to retain the member(s) inside the passageway. Thus, the connector mechanically connects the inserted member(s) to each other and/or to another object to which the connector is mechanically connected. For example, members inserted into opposite ends of the passageway of the connector, or multiple members inserted together into one end of the passageway, will be mechanically connected. In certain embodiments, the connectors may be used to mechanically connect one or more members inserted into one, or optionally two ends of the passageway, to a fastener that is connected to or fixed to another object, for example, a construction or other utilitarian element.

The preferred axial-pull connector comprises a spiral structure (or "helical" or "coiled" structure) that elongates when said structure is put under tension along its longitudinal axis. During this elongation, at least portions of the spiral structure, for example one or more coils of the spiral, will become reduced in inner diameter to reduce the diameter of at least a portion, or preferably at least a substantial portion, of the hollow passageway inside the structure.

Depending on the materials of the connector parts and the inserted member(s), electrical connection between the inserted member(s) may be achieved. Depending on the materials of the connector parts, the inserted member(s), the fastener, and said another object, electrical connection between the inserted member(s) and said another object may be achieved. For example, if inserted members are of electrically-conductive material and their lengths overlap, for example, the stripped strands of multi-strand cables, the inserted members (strands) will be squeezed together into tight contact and, hence, into electrical contact with each other. For example, if the material of the spiral coils forming the passageway is also electrically-conductive, the squeezing of inserted member(s) inside the passageway will form an electrical connection between the member(s) and the spiral coils; this way, if electrically-conductive members are inserted into opposite, open ends of the connector passageway, the conductive spiral coils will place the oppositely-inserted members into electrical connection with each other even if said inserted members are not touching each other. For example, if the inserted member(s) is/are electrically conductive, spiral coils forming the passageway, and the fastener are electrically conductive, and said another object is electrically conductive and in electrical connection with said conductive spiral coils, then the inserted member(s) is/are in electrical connection with said another object.

In certain embodiments, a connector may comprise one spiral, or multiple spirals, that each comprises multiple coils. Multiple spirals may be connected to each other mechanically and/or electrically. For example, a "spiral-unit" may comprise multiple spiral portions connected by a non-spiraled region, for example, a spiral-unit with a spiral portion at or near each end of the spiral-unit and with a non-spiraled central portion about midway along the spiral-unit. A spiral-unit, therefore, need not in all embodiments have coils all along its length but instead may have non-spiral regions, as long as the non-spiral regions do not significantly interfere with axial movement and tightening of the diameter of the spiral regions. In many embodiments, multiple spiral portions of a spiral-unit will typically coil around a single longitudinal axis; thus, multiple spiral portions may be longitudinally aligned.

In certain embodiments, multiple spirals, or multiple spiral-units each comprising multiple spiral portions, may be coaxially-arranged or generally-coaxially-arranged, and, hence, the connector may be called a "multi-layer" connector for connecting coaxial or other "multi-layer" assemblies, such as multi-layer cable. A multi-layer connector may be used to mechanically (and optionally also electrically) connect elongated outer strand(s)/member(s) of a first assembly to the elongated outer strand(s)/member(s) of a second assembly, and to mechanically (and optionally also electrically) connect central core strand(s)/member(s) of the first assembly to central core strand(s)/member(s) of the second assembly. Such connectors are beneficial for connecting, for example, two aluminum-conductor steel-reinforced ("ACSR") cables, wherein each has a steel core of multiple steel strands, and outer aluminum strands surrounding the steel core.

Certain embodiments of the multi-layer connector comprise two spiral ends and a central spiral-unit, wherein the two spiral ends are generally larger in diameter than the central spiral-unit. Two "coaxial" or "multi-layer" cables, typically not comprising insulation at least on the cable ends, are received in the opposing ends and are each captured and retained by a respective spiral. The outer strands of each cable are preferably cut or otherwise shortened relative to the core strands of each cable, so that the core strands extends further into the connector to enter into, and be captured and retained in the central spiral-unit. Sleeve(s) or other housing system(s) connect the two spirals ends to each other and/or to the central spiral-unit so that the connector is a single unit capturing and securely retaining the outer strands and also the core strands of the cables. Materials of the spiral ends, the central spiral-unit, and the sleeve(s)/housing(s) may be made of different materials and may be selected to maximum mechanical strength, and/or electrical conductivity, if desired.

Certain embodiments may mechanically connect end-to-end, and optionally also electrically connect in some embodiments, cables, bars, rods, or reinforcing bar ("rebar") or other elongated members, for use in construction or other utilitarian applications. Certain embodiments of the connector may have a spiral/spiral-unit at each end of the connector, with a turnbuckle or other adjustment system in between the two spirals/spiral-units for adjusting length of the connector and, hence, the tension or position of the connected elongated members. Alternatively or additionally, an alternative adjustment system may be provided between the two spirals/spiral-units for adjusting the angle of the captured elongated member(s) at one end of the connector to the captured member(s) at the other end of the connector.

Certain embodiments may mechanically connect, and optionally also electrically connect in some embodiments, a member or members inserted into the connector to another object via a fastener(s). For example, a cable, bar, or rod, rebar, or other member may be captured in one portion of the connector and then connected via the fastener(s) to a building, bridge, beam, post, footing, foundation, roof, or other construction or utilitarian object. The connector may include length-adjustment, pivot, swing, or sliding adaptations, for example for improved installation or adjustment of the connector, and hence of the cable, bar, rod, rebar, or other member, relative to the construction or other utilitarian object. For example, a turnbuckle or a ball-joint may be provided as a portion of the fastener and/or between the fastener and the spiral/spiral-unit.

These and other features and objects of certain embodiments of the invention will be apparent after reading and viewing this document and its drawings.

BRIEF DESCRIPTION OF THE DRAWINGS

FIG. 55 is an exploded perspective view of the connector of FIGS. 51-54.

FIG. 56 is an exploded side view of the connector of FIGS. 51-55.

FIG. 57 is a longitudinal cross-section of the plate element of the connector of FIGS. 51-56.

FIG. 58 is a longitudinal cross-sectional view of the nut element of the connector of FIGS. 51-57.

Note that only FIGS. 7, 9, 14 and 15 show members inserted into and captured by the connector for mechanical and/or electrical connection. However, it will be understood from this description that the other Figures also portray connectors that receive and tighten onto inserted members. The tightening of each spiral or spiral portion onto the inserted member(s), by means of axial-pulling on, and resulting elongation and diameter-reduction of, the spiral or spiral portion, will be understood from this description and the drawings. However, the elongation and diameter-reduction in FIGS. 7, 9, 14 and 15, relative to the Figures showing a spiral or spiral portions tightened onto inserted members, may not be immediately apparent to a viewer, as effective elongation and diameter-reduction may be relatively small in certain embodiments compared to the dimensions of the connector and inserted members. For example, it may be desirable for the diameter of the inserted members to be almost as large as the inner diameter of the relaxed spiral or spiral portion (before tightening), and therefore only a small amount of elongation and diameter reduction is needed for effective tightening onto, and resulting capture of, the inserted members.

DETAILED DESCRIPTION OF CERTAIN EMBODIMENTS

Figure 1:
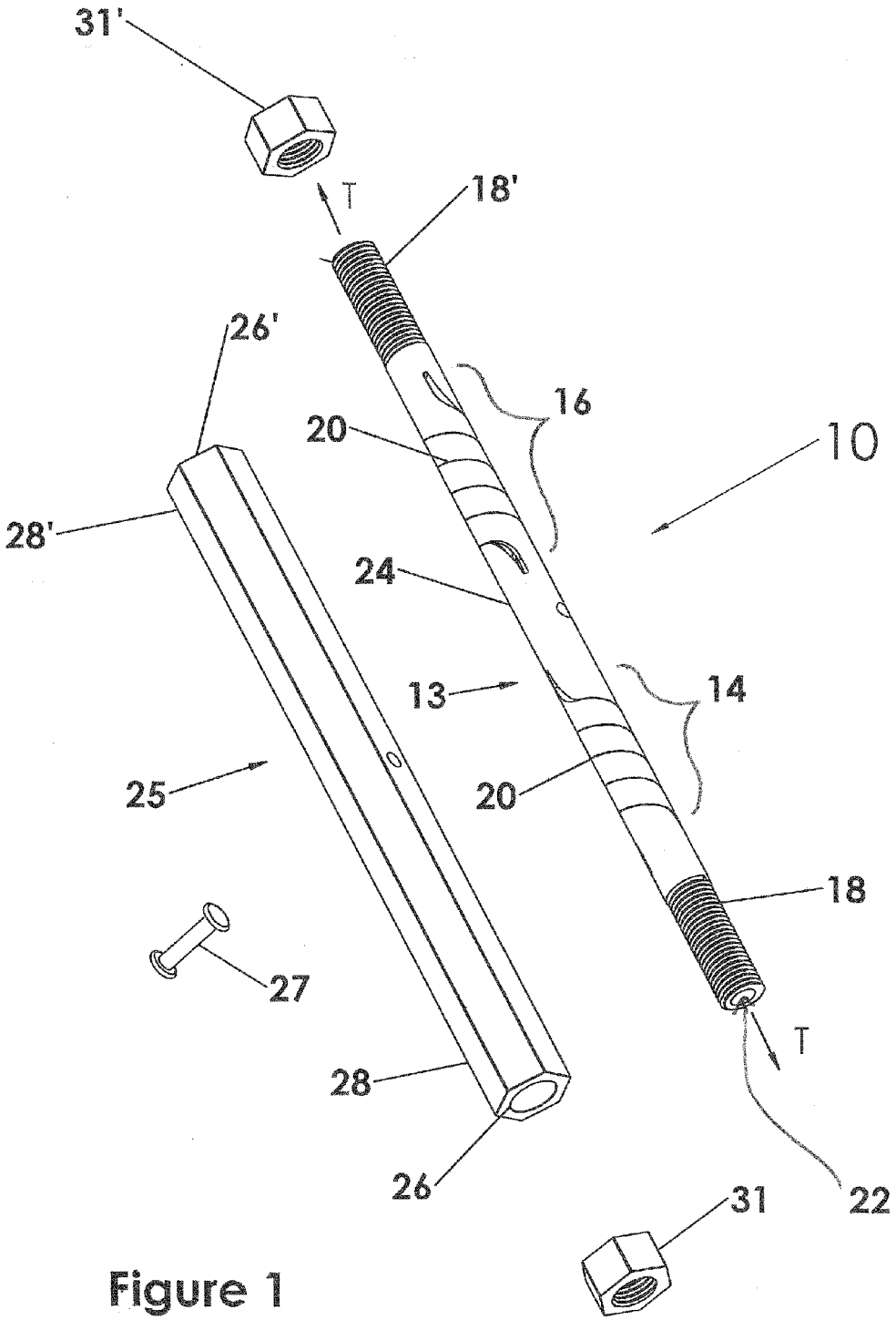
FIG. 1 is an exploded perspective view of one embodiment of an axial-pull connector.

Referring to the drawings, there are shown several but not the only embodiments of the invented connector. The connector comprises a spiral or one or more spirals, one or more spiral portions, or a helix or one or more helices, but hereafter the term "spiral" is used, or the term "spiral portion" is used in the case of a spiral unit that has multiple spiral regions with one or more non-spiraled regions between or adjacent to the spiral regions. For example, dictionary definitions of "spiral" typically include definitions such as: a) a three-dimensional curve (as a helix) with one or more turns about an axis, or b) the path of a point in a plane moving around a central point while continuously receding from or approaching it. While certain spirals in the preferred connectors may fall under either of these definitions, it is preferred in many embodiments that the spiral has generally or substantially or entirely the same inner diameter along its length, rather than significantly changing its diameter along its length. Therefore, definition "a" above is preferred when describing the spirals or spiral portions for most embodiments.

The coils of each spiral or spiral portion may be formed, for example, by cutting tubular stock, or by wrapping or winding material, to surround and define an internal passageway with at least one open end, and in many embodiments two open ends, for insertion of the inserted members. The individual coils that form a given spiral or spiral portion are typically of the same or nearly the same diameter (especially, in most embodiments, the same or nearly the same internal diameter) but may optionally be of different diameters in certain embodiments as suggested in the paragraph immediately above.

The coils of the spirals and spiral portions are each preferably at least somewhat flexible and/or bendable, so that pulling axially on an end or both ends of the spiral will lengthen the spiral without breaking or cracking the spiral. Said lengthening may be achieved mainly or entirely, for example, by means of the coils flexing/bending while separating and tightening in diameter. In certain embodiments, the coils are resilient, which results in the tension placed on the spiral or spiral portion ("spiral/portion") being resisted by the spiral/portion's resiliency, that is, by the material's natural bias to return to its original length and shape. In certain embodiments, said resiliency will be a factor in latching or locking the spiral/portion in the tightened position. For example, a tightener that screws in one direction onto the end of the spiral/portion, and abuts against a housing, may be held tightly against the housing upon tightening of the spiral/portion due to said natural resiliency of the spiral/portion, and, hence, the tightener will be less likely to rotate in the opposite direction and become unintentionally loosened by vibration or impact. In certain embodiments, therefore, the spiral may be, or may be similar to, a spring, for example, being resilient and naturally biased to remain in its shortened, larger-diameter (the relaxed position) but moveable into the axially-pulled, longer and tightened-diameter upon application of sufficient axial tension.

One of skill in the mechanical arts will understand, after reading this document and viewing the drawings, that pulling axially outward on both ends of a spiral of these connectors, herein, or on one end while the other end or a central or other region of the spiral is fixed/secured, will move the individual coils of the spiral so that the spiral will lengthen while the coils (typically each coil) tighten to be smaller in diameter than when the spiral is in a shortened (relaxed, non-axially-pulled) configuration. The material and shape of the spiral, therefore, allows the spiral to elongate when both ends (or one end relative to a fixed end or region) are pulled axially outward, preferably with this elongation occurring by means of movement and tightening of all or nearly all the coils, rather than by any significant stretching/thinning of the material of one or more of the coils. Also, it will be understood that a spiral-unit with multiple spiral portions and at least one non-spiral portion will act similarly or the same as described above in this paragraph, wherein pulling axially outward on both ends of the spiral-unit at the same time can tighten all spiral portions, or pulling axially outward on one end while the other end or a central or other region of the spiral is fixed/secured can tighten the spiral portion(s) between said one end and the other, fixed/secured end, or can tighten the spiral portion(s) between said one end and said central or other fixed/secured region.

Certain embodiments of the connector comprise a threaded, slanted, ramped, and/or cammed actuation system that directly or indirectly applies a force on an end/region of the spiral to pull the end/region axially away from "a fixed/secured region" of the spiral, to accomplish the axial pull and consequent lengthening and tightening. In certain embodiments, a rotatable member threadably engages the end/region of the spiral, and turning the rotatable member against a non-compressible, non-moving abutment surface (such as an abutment surface of a housing) will cause the relative motion of the rotatable member and the end/region, to pull axially on the said threaded end/region. In other words, the rotation of the rotatable member is converted into linear motion of the end/region. One may understand, from this disclosure, how the threads serve as one embodiment of a slanted or ramped system for accomplishing the axial pull.

In certain embodiments, the rotatable member may be a threaded nut-style tightener, which threadably engages a threaded first region of the spiral or spiral-unit. The tightener slidably abuts against a rigid and incompressible (or, less preferably, substantially rigid and substantially incompressible) abutment surface of a housing sleeve encircling the spiral, wherein the housing sleeve is fixed to a second region of the spiral or spiral-unit. When the tightener is rotated/twisted further onto the threaded first spiral region (further toward the center of the spiral or spiral unit), the tightener's movement relative to the abutment member is limited to rotation, and that rotation by means of threaded-engagement forces the threaded first spiral region axially away (outward) from the abutment member and, therefore, axially away from the second spiral region. This axial force/pulling serves to length the spiral, whereby its coils naturally move to a smaller-diameter configuration as, in effect, the first spiral region is pulled away from the second spiral region. The resulting reduced-diameter of the spiral, preferably all the way from at or near the first spiral region to at or near the second spiral region, will squeeze and grip the member(s) received inside the tightened/smaller spiral passageway. Said first spiral region and said second spiral region may be opposite ends of a spiral, for example, wherein pulling on both ends tightened the single spiral structure between the two ends.

In spiral units comprising multiple spiral portions and at least one non-spiraled portion, said first spiral region may be an end of the spiral-unit, and said second region may be a central portion of the spiral-unit that is fixed to the housing, for example. In such cases, the pulling of the first spiral region relative to the central portion serves to tighten one of the multiple spiral portions of the spiral-unit. To tighten the other spiral portion(s) of the spiral-unit, a similar procedure is followed, wherein the opposite end/region of the spiral-unit may also be threaded and a second threaded nut-style or other tightener is screwed into said opposite end/region to tighten the spiral portion at or near said opposite end/region. Said second tightener may slidably abut against a surface of a rigid and incompressible abutment member, for example, the opposite end of said housing sleeve. When the second tightener is rotated/twisted further onto the threaded opposite end/region of the spiral-unit, the second tightener's movement relative to the abutment member is limited to rotation, and that rotation by means of threaded-engagement forces said opposite end/region of the spiral-unit axially away (outward) from the abutment member and, therefore, axially away from the central portion of the spiral-unit. This axial force/pulling serves to lengthen the spiral near said opposite end/region whereby its coils naturally move to a smaller-diameter configuration as said opposite end/region of the spiral is pulled away from the central portion. The resulting reduced-diameter of the spiral portion, preferably all the way from at or near said opposite end/region to at or near the central portion, will squeeze and grip the member(s) received inside the tightened/smaller spiral passageway. This configuration may be envisioned, for example, to connect two cables or other members that are inserted into openings in the two opposing ends of the connector. If the cable/members inserted into the two ends comprise strands/wires, the strands/wires of each cable will be squeezed together in tight contact and captured inside the spiral passageway. If the cable strands/wires and also the spiral unit are electrical conductive, the two tightly-squeezed cables will become electrically connected with each other even when they don't touch each other.

A spiral or spiral-unit may be supplemented by other fasteners or adjustors. For example, terminal ends, fasteners, turnbuckles, mounts, pivots, lockable or latchable pivots, plates, ball joints, lockable or latchable ball joints, or other mechanical or electrical fasteners or adjustment members may be provided in combination, either connected or integral, with a spiral-based connector. Certain embodiments will require certain elements to be electrical conductive, for example, the entire or substantially the entire spiral-unit and whatever fasteners or adjustment members that are attached or that extend from the spiral or spiral-unit. Certain embodiments for mechanical connection only will not require said spiral/spiral-unit or the attached/extending fasteners/adjustors to be electrically-conductive. Certain embodiments of the disclosed connector technology may be used to mechanically connect two or more members that are squeezed/gripped inside the connector, for example, any elongated members such as rods, bars, poles, re-bar, cable, wire, strands, and/or straps, for example. Said mechanical connection may comprise connecting elongated members so they are coaxial or generally coaxial, for example, end-to-end or nearly end-to-end. Or, said mechanical connection may comprise connecting elongated members so that they are side-by-side or overlapped, for example, bundles of elongated members such as wires or strands of a single cable, or of multiple cables, inserted together into one end of the connector. For mechanical connection, the inserted members are typically non-compressible and non-elastic, so that the inserted members do not significantly deform or stretch when squeezed by the connector, thus, providing a permanent or semi-permanent connection.

Certain embodiments of the disclosed connector technology may be used to mechanically connect two or more members that are squeezed/gripped inside the connector, for example, any elongated members such as rods, bars, poles, re-bar, cable, wire, strands, and/or straps, and to connect said two or more members to another object. For example, certain embodiments may connect the one or more members to a construction element or other utilitarian object, such as a building, bridge including a bridge upright or buttress, beam, buttress, post, footing, foundation, roof, or other construction or utilitarian object. Certain of these embodiments may include, in addition to one or more spiral-units, a fastener or adjustor, such as a eyelet, terminal, hook, ball-joint, turnbuckle, etc.

It will be understood that many of the mechanical connections described herein also may be electrical connections, for example, if electrically-conductive members are being mechanically connected with either said conductive members touching each other, or with electrically-conductive structure ("intermediate" structure) contacting and extending between the members to "close" the circuit. Therefore, certain embodiments of the disclosed connectors may be used to electrically connect two or more electrically-conductive members that are squeezed/gripped inside the connector, for example, any electrically-conductive elongated members such as rods, bars, poles, re-bar, cable, wire, strands, and/or straps, for example. Said electrical connection may comprise electrically connecting said elongated members so they are coaxial or generally coaxial, for example, end-to-end and touching, or distanced from each other but connected with intermediate electrically-conductive structure. Said electrical connection may comprise electrically connecting said elongated members so that they are touching each other by being side-by-side or overlapped, for example. For electrical connection, the inserted members typically will be stripped of insulation prior to insertion, as the electrical connection relies on contact between electrically-conductive spiral and other connector element(s) and electrically-conductive inserted member(s).

The inventor has filed applications and issued patents that disclose the broad concept of a tightenable spiral(s) for a connector, wherein the spiral(s) is/are moved from a relaxed configuration having a relaxed diameter, to a tightened configuration having a tightened diameter smaller than the relaxed diameter, in order to tighten on, and capture, elongated members inserted into in the passageway of the spiral(s). The broad concept also includes latching or locking the spiral in that position for permanent or semi-permanent use in the tightened configuration. Inventor's issued patents are U.S. Pat. Nos. 7,794,255; 7,901,233; 8,066,525; 8,246,370; and 8,771,000.

The present connectors fall under that broad concept definition, as they also comprise a tightenable spiral(s) in a connector, wherein the spiral(s) is/are moved from a relaxed configuration having a relaxed diameter, to a tightened configuration having a tightened diameter smaller than the relaxed diameter, in order to tighten on, and capture, elongated members inserted into in the passageway of the spiral(s). The present connectors also may includes latching or locking the spiral in that position for permanent or semi-permanent use in the tightened configuration.

However, the inventor's earlier connectors rely on twisting ends of spirals/spiral-units to tighten the spiral coils, that is, applying a rotational force on an end of the spiral, so that the end rotates on the longitudinal axis of the spiral, relative to another end/portion of the spiral. The rotational force on the spiral end is typically applied by a user twisting a housing end-cap or other housing-portion that is fixed to the end of the spiral to be rotated. Latching/locking the end-cap/housing-portion and the spiral end in the rotated location, in order to latch/lock the spiral in the tightened configuration, is done by latching/locking the end-cap or other housing-portion to yet another housing portion after the tightening has been accomplished. Some small amount of lengthening of such spirals may occur as a result of the rotational tightening, but the main force, action, and movement is rotational rather than axial. Also, the end-cap or other housing portion that serves as the "handle" for rotating the spiral end is not described as relying on axial-direction-abutment against a housing portion to limit movement of said end-cap/housing-portion in an axial direction.

In the present preferred embodiments, the force applied to the spiral is done by a tightener (tensioner) moving relative to the spiral. That relative movement, preferably by threaded engagement of a threaded tightener with a threaded spiral end/region, pulls the spiral axially, that is, linearly. The current preferred connectors utilize substantially or entirely axial force and axial movement of the spiral to tighten the spiral. In order to pull the spiral end/region axially, the tightener rotates and slides relative to the threaded end of the spiral, enabled by the tightener also rotating and sliding relative to (against) a radial abutment surface provided by a non-compressible surface such as a housing surface. Thus, the tightener is stopped from axial movement in the direction toward the housing, and the forces of further screwing the tightener onto the spiral end/region pull the spiral end/region away from the housing (axially outward).

In other words, while the inventor's earlier twist-tightened connectors and the presently-preferred embodiments are subsets of spiral-based connectors that are tightened by diameter-reduction after members-to-be-connected are inserted into the connector, the earlier and the present connectors differ in certain details. The earlier connectors use rotation of a handle to rotate the spiral end on the longitudinal axis of the connector and the spiral, while the present connectors use rotation of a handle to convert that handle rotation, via a threaded sliding engagement of the handle to the threaded spiral, into linear motion of the spiral. Referring Specifically to the Figures:

Referring to the attached Figures, there are shown several, but not the only, embodiments of the disclosed connectors.

FIGS. 1-4 portray one embodiment of a connector 10, with spiral unit 13, that may be used for mechanical and optionally electrical connection. Spiral-unit 13 is an elongated, generally cylindrical/tubular structure comprising two spiral portions 14, 16. One spiral portion is near each threaded end 18, 18'. An effective way of tightening the spiral-unit 13 is to pull the ends 18, 18' axially outward, that is, linearly outward along the longitudinal axis of the spiral-unit 13, away from the central portion 24 of the spiral-unit. Such axial movement/pulling will pull the coils/wraps 20 apart and reduce their diameter(s) (inner and outer diameter), consequently tightening and lessening-the-diameter(s) of the hollow passageway(s) inside the spiral-unit.

Therefore, in particularly-preferred, embodiments, the tightening mechanism is substantially or entirely axial movement of the ends 18, 18' of the spiral-unit 13. Connector 10 comprises a body 25 (or housing in certain embodiments) into which the spiral-unit 13 is inserted, with the central portion 24 fixed to the body 25 by a rivet 27 or other fastener, such as pin, adhesive, bolt, weld, or clip. Threaded nuts 31, 31' or other threaded tightener members, are threadably installed on the ends 18, 18', and rotating/turning them towards the central portion 24 of the spiral-unit and the center of the body 25, while holding/restraining the body 25, will eventually move the nuts 31, 31' to abut against the radial end surfaces 26, 26' of the body ends 28, 28'. Further rotating/turning of the nuts 31, 31' cannot move the nuts 31, 31' closer to each other or closer to the central portion 24 of the spiral-unit or the center of the body 25, due to the substantially, or preferably entirely, non-compressible body 25, and specifically the end surfaces 26, 26' being in the way. However, said further rotating/turning of the nuts 31, 31' against the body 25 results in tension on the spiral-unit 13 (see arrows T), so that the spiral portions 14, 16, and hence the entire spiral-unit 13, elongate under said tension. Thus, said further rotating/turning of the nuts 31, 31', pulls the ends 18, 18' and the spirals axially outward relative to the body 25, thus, separating the coils/wraps and tightening them in diameter.

Note that the spirals in the exemplary spiral-unit 13 of FIGS. 1-4 are shown as left-handed spirals and the threads are right-handed threads. Rotating/turning the nut 31 clockwise, when viewed from the bottom edge of FIG. 1, would thread the nut onto the spiral-unit 13 end until it abuts into surface 26, after which further rotating/turning of nut 31 in the clockwise direction will pull the end 18 outward.

Nut 31', end 18', and spiral portion 16, are also right-hand threaded, so that, when viewing the connector 10 from the top edge of FIG. 1, nut 31' would be turned clockwise. Again viewing from the top edge of the sheet, end 18' would move axially to toward the top edge of the sheet.

Alternative threading may be used for connector 10 and/or for the other connectors shown herein. For example, ends of the spiral and respective nuts may have left-handed threading, in which case, like the right-handed example, a person may comfortably rotate the two nuts at the same time with two hands moving in opposite directions, or with two hand-held wrenches moving in opposite directions. Or, one end of the spiral and its nut may be right-handed in threading while the other send of the spiral and its nut may be left handed, which may be operable but may result in less intuitive operation for a user as the user will typically have to tighten each nut at different times while holding onto the center of the body. Note, too, that connector 10 and/or the other connectors shown herein may have alternative spiral winding direction(s). For example, in certain embodiments, spiral winding may be 1) all right-handed, 2) all left-handed, or 3) portion(s) that are right-handed and portion(s) that are left-handed. In certain embodiments, the threading on the spiral(s) ends/regions and corresponding, cooperative threading on a tightener (tensioner), for tightening the spiral(s), may be for each of said options 1, 2, and 3, any of: a) all right-handed, b) all left-handed, or c) "mixed" meaning that one end/region is right-handed and another end/region is left-handed.

Not shown in FIGS. 1-4, but understood, are the elongated members, such as bars, poles, re-bar, cable, wire, and/or strands, that may be inserted into and connected by the connector 10 and that, hence, are also called "inserted members". One or more of said elongated members will be inserted into the passageway 22 of each end of the connector, by being inserted through each nut 31, 31' and into the ends 18, 28 and 18', 28' of the spiral-unit-body combination. Once the elongated members are inserted into the relaxed (untightened, large diameter) configuration of the connector, the body may be gripped (for example, by a wrench) and the nuts 31, 31' may be tightened by another wrench or other tool, to tighten the spiral portions 14, 16 around the inserted elongated members. Or, in certain embodiments, the user may grip both nuts 31, 31' and rotate them in opposite directions, without gripping the body, to tighten both spiral portions 14, 16 at the same time. Note that the body and the nuts have polygonal outer surfaces to aid in gripping by a wrench/tool.

Note that the rivet 27 fixes the central portion 24 of the spiral-unit 13 to the center of the body 25, so that the inner end of each spiral portion 14, 16 is anchored to the body, allowing the user to hold/restrain the body (and hence the central portion 24) and to turn each nut 31, 31' independent and at separate times to tighten each spiral. If the spiral-unit 13 were not fixed to the body, holding/restraining the body while turning a single one of the nuts could pull the entire spiral-unit 13 axially inside the body without stretching and tightening the spiral-unit, especially if the opposite nut were not tightened against the opposite end of the body.

Fixing the spiral-unit to a body/housing could be done in different ways, for example, fixing a given end of the spiral-unit to the body by a pin or rivet or by another fastener. Fixing the spiral/spiral-unit to the body/housing at one end, instead of providing a rotatable nut, may be effective in providing a single-entrance connector, wherein elongated members (such as wires, rods, cables or other elongated members) would be inserted in the single-entrance of the passageway, and would be connected mechanically and optionally also electrically by being squeezed together, side-by-side, inside the spiral(s). Therefore, one end of such a spiral-unit could be fixed to a housing/body, and both spiral-unit and body at that end could be closed and/or could comprise a terminal/fastener for connection to another structure. Thus, the open end (with open passageway) would comprise the tightening/pulling nut that would be pulled to tighten the spiral-unit around whatever structure(s) is/are inserted into the passageway of the spiral(s) from the one end.

Figure 2B:
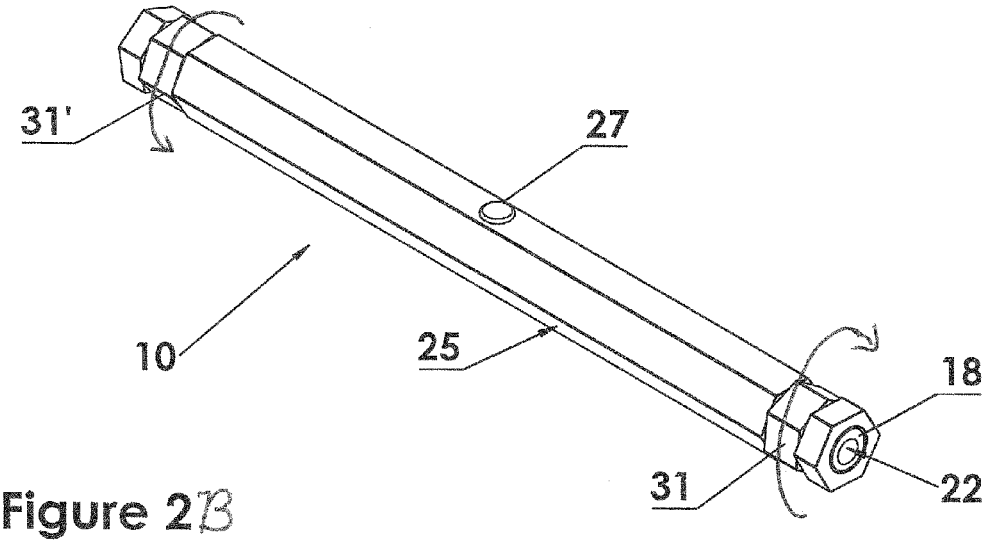
FIG. 2B is a perspective view of the assembled connector of FIG. 1, with the lock nuts of FIG. 2A included.
Figure 2A:
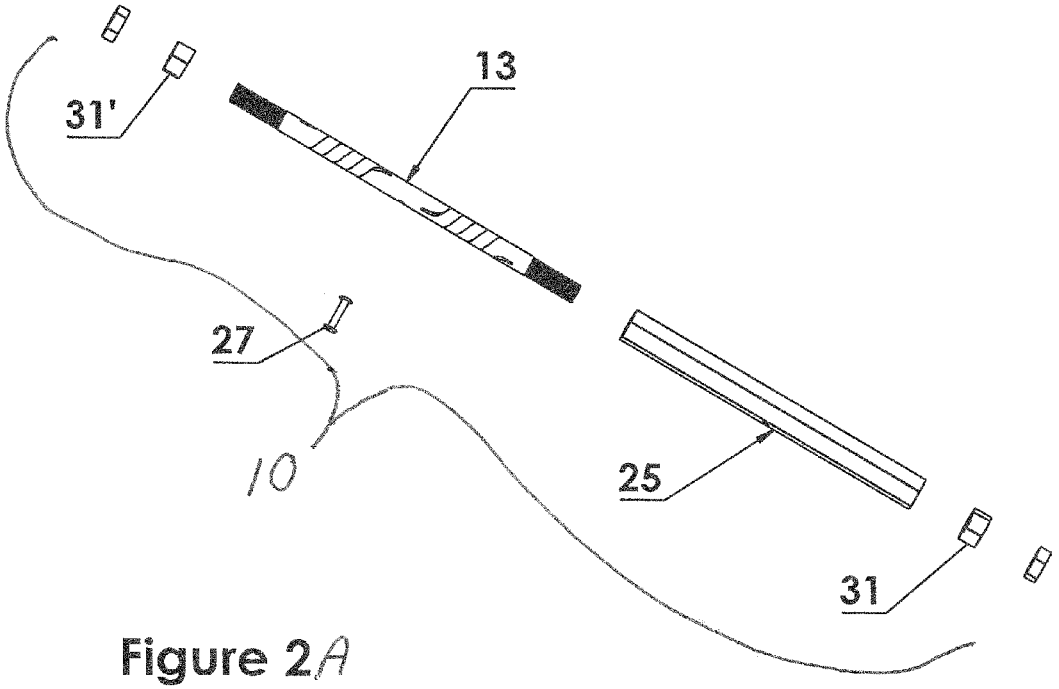
FIG. 2A is an exploded side view of the connector of FIG. 1, with lock nuts added at each end of the connector.
Figure 3:
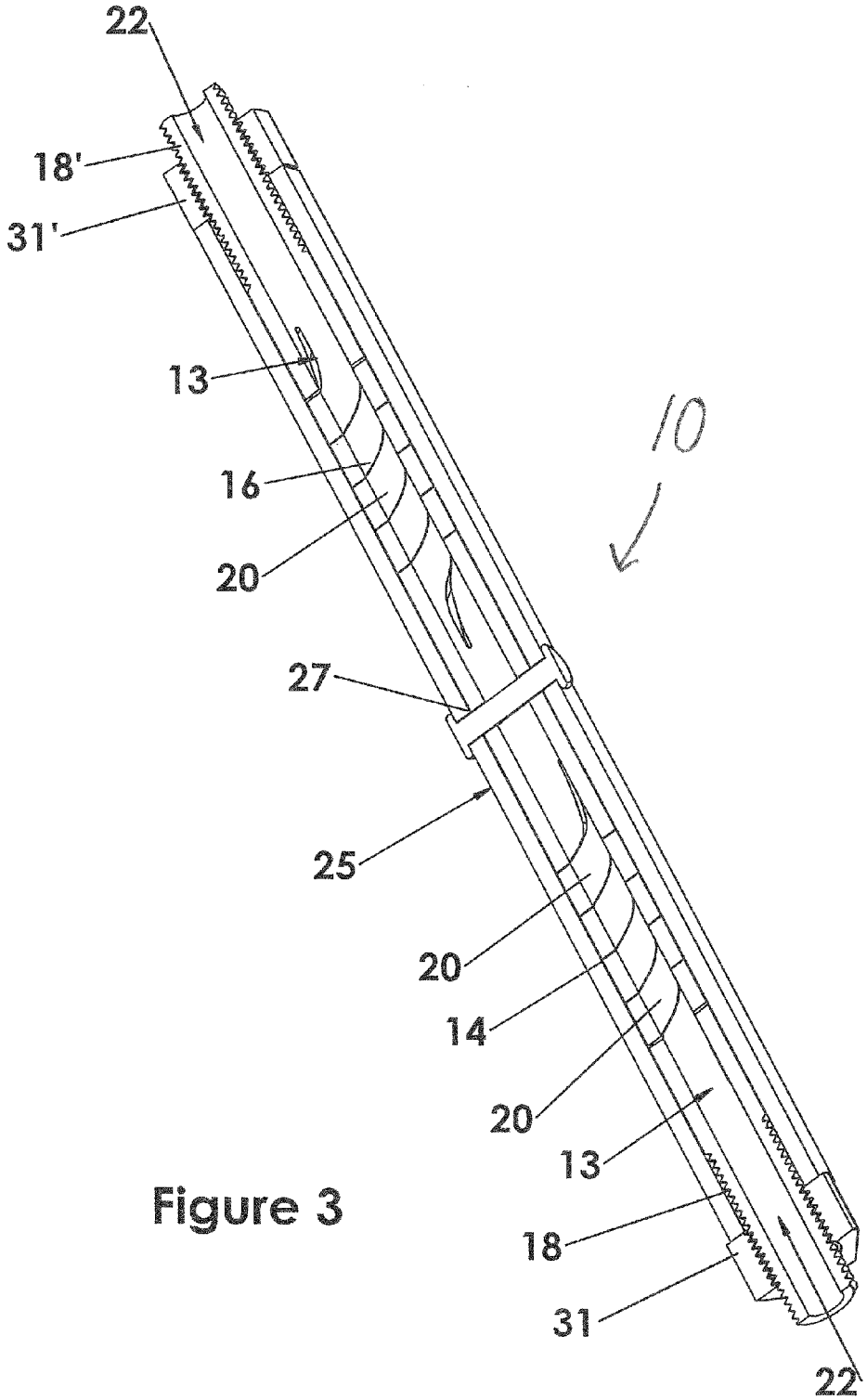
FIG. 3 is a longitudinal cross-sectional view of the connector of FIG. 1.
Figure 4:
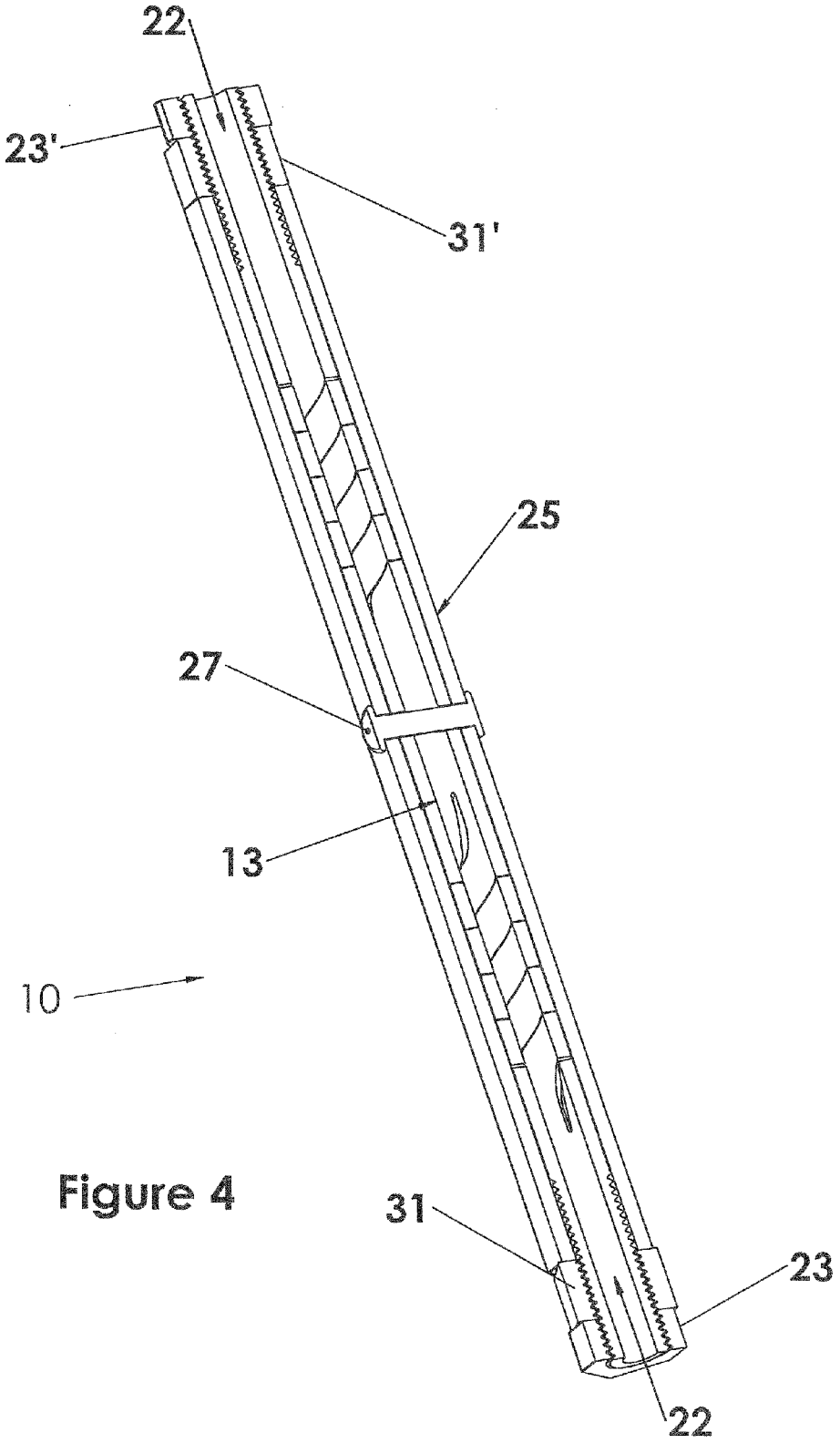
FIG. 4 is a longitudinal cross-sectional view of the connector of FIG. 1, with the FIGS. 2A and B lock nuts added on each end to enhance the security/permanence of the connection.

FIGS. 2A, 2B, and 4 show the connector 10, again without any elongated members installed in the passageway 22, but with added structure of two lock nuts 23, 23' for keeping the tightened nuts 31, 31' in proper position (without rotating in reverse) to maintain the spiral(s) in the tightened configuration. It may be understood that the lock nuts will be tightened against the nuts 31, 31' after tightening of the nuts 31, 31'.

Figure 6:
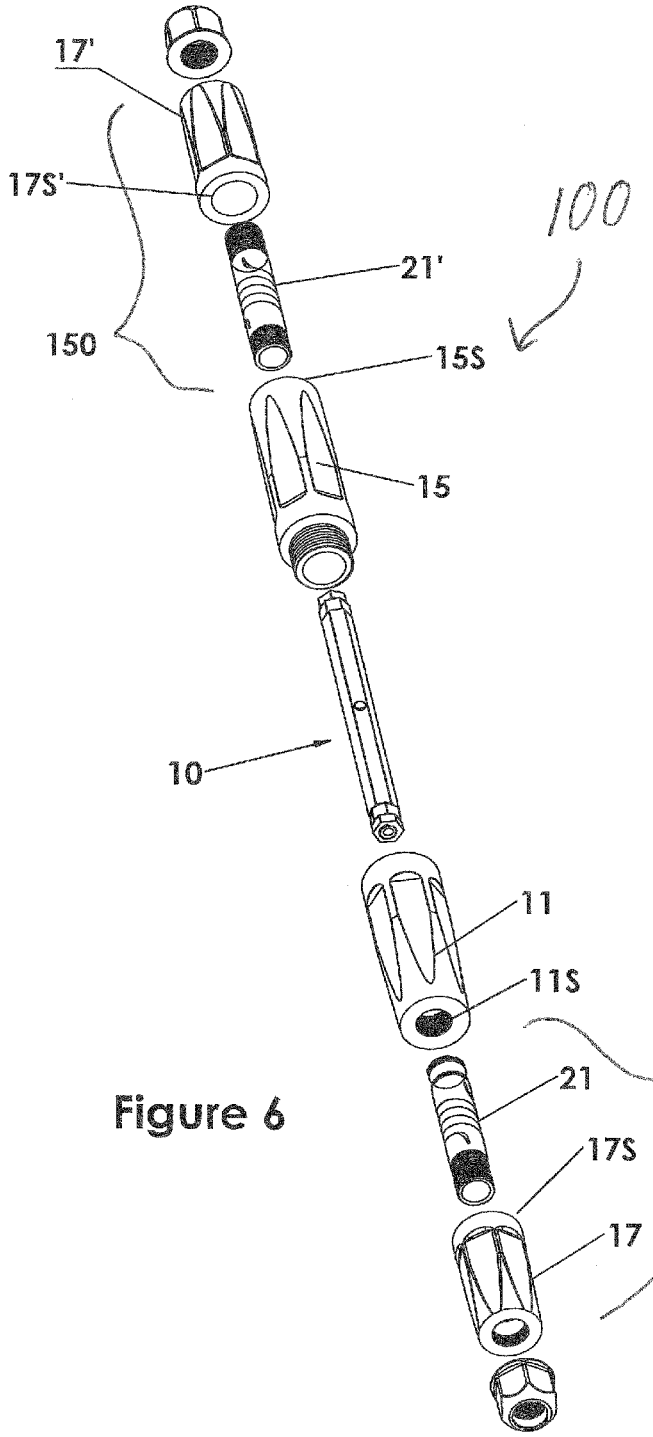
FIG. 6 is an exploded perspective view of the connector of FIG. 5.
Figure 5:
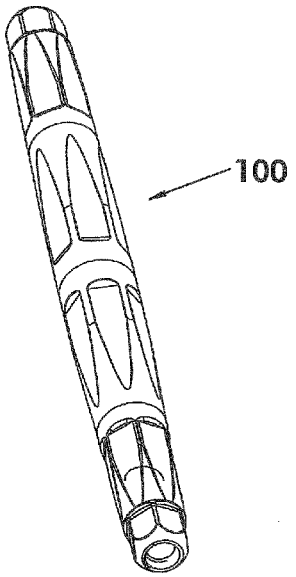
FIG. 5 is a perspective view of an alternative, assembled axial-pull connector, for connection of coaxial or other multi-layer assemblies, wherein the connector comprises two spiral for connection of the outer strands of the cables and a supplemental core spiral-unit for connection of the cores of the cables.
Figure 7:
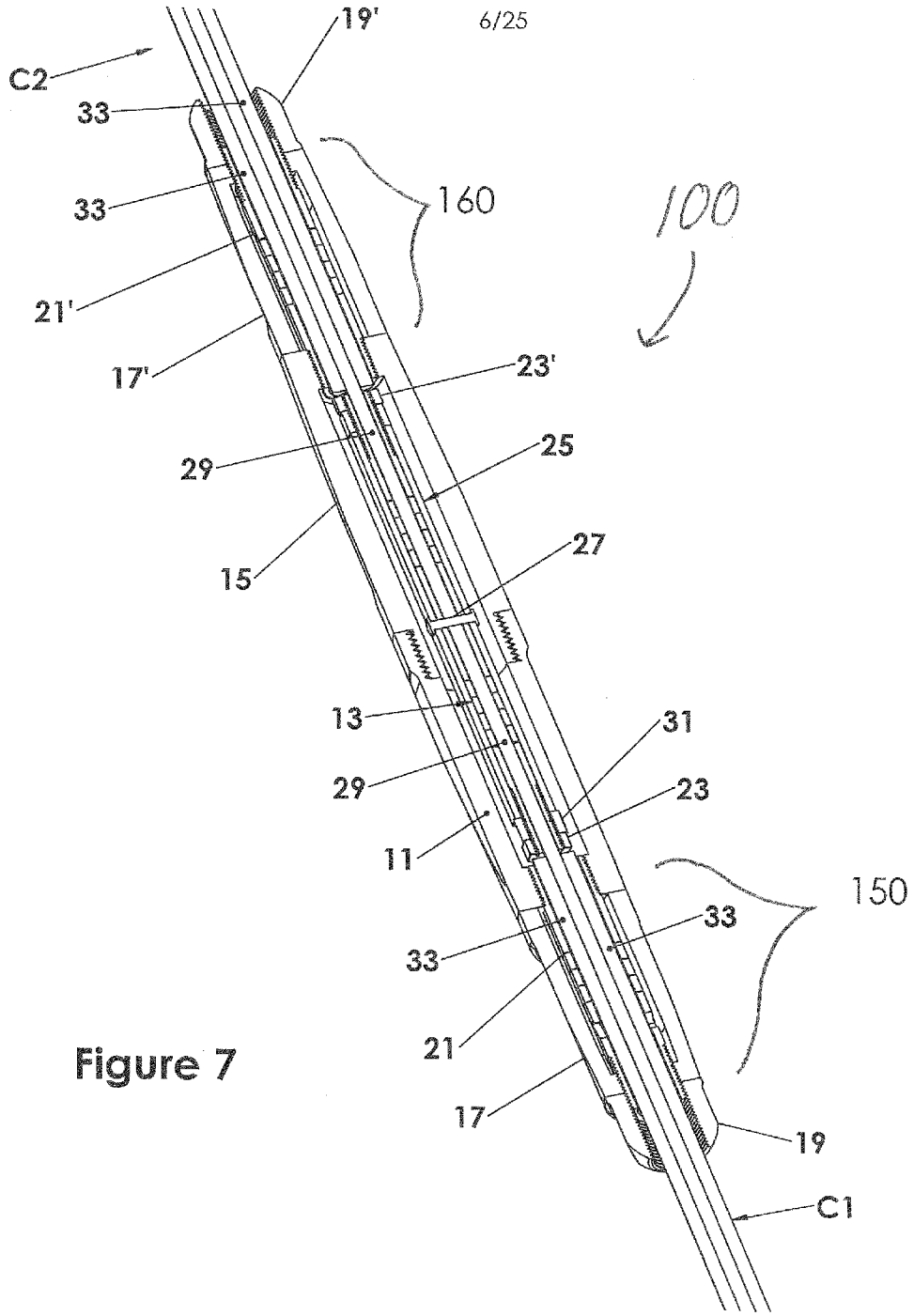
FIG. 7 is a longitudinal cross-sectional, perspective view of the connector of FIGS. 5 and 6, capturing and connecting the cores, and the outer strands, of the two cables inserted into the connector, by the core spiral-unit tighteners (here, nuts) pulling the ends of the core spiral-unit axially outwardly to tighten the core spiral-unit around the cable cores, and by the end tighteners pulling the end spirals axially outwardly to tighten the end spirals around their respective cables.

FIGS. 5-7 show an alternative connector 100 comprising multiple spiral-units and being specially-adapted for "multi-layer" connections. The connector 100 comprises a central assembly that is the same or similar to connector 10, plus left and right end assemblies 150, 160 that each comprises a spiral. Left and right end assemblies 150 and 160 each utilize axial-pull spirals/methods, such as those described earlier in this document, to form mechanical and optionally electrical connections. Connector 10 and the left and right end assemblies 150, 160 are separately and independently tightenable from a relaxed configuration to an elongated, smaller-diameter, tightened configuration. As illustrated in FIG. 7, connector 100 may be used to connect various portions/layers of cables C1, C2. For example, the inner layer or "core" of the cables (one or more inner strands/wires of the cables, here, the single inner strand 29) may be connected by connector 10. The outer layer, or outer strand(s)/wire(s), for example, the multiple outer conductor strands 33, may be connected by left and right end assemblies 150, 160 in combination with the outer housing sleeves (such as center shells 11 and 15) that extend across/along the outside walls of connector 10 to connect said left and right end assemblies 150, 160.

When connected, the two center shells 11 and 15 are threadably or otherwise connected, to form a housing over connector 10 and to connect the left and right end assemblies 150, 160. Spiral-units 21, 21' are threadably connected at their inner ends to the outer ends of the center shells 11, 15, respectively, and tensioners 17, 17' (also "tighteners") are threaded onto the outer ends of the spiral-units 21, 21'. The spiral-units 21, 21' are threadably inserted into the shells 11, 15 to a point where they are limited from further rotation motion or axial motion toward the center of the connector 100. The tensioners 17, 17' may then be rotated by a user, in a similar manner as nuts 31, 31', wherein said rotation quickly takes the tensioners 17, 17' to a point where their surfaces 17S, 17S' abut against the surfaces 11S, 15S of the shells 11, 15. Further rotation of tensioners 17, 17' will then tension the spiral-units 21, 21', to force the ends of the spiral-units 21, 21' axially outward, lengthening and tightening spirals 21, 21' in a manner similar to that discussed above and elsewhere in this document. Optional, but preferred, locking nuts 19, 19' may be provided to serve as locking means to keep the tensioners in the tightened configuration wherein spirals 21, 21' are each in their tightened configuration, that is, the reduced diameter, elongated configuration. Thus, it may be seen to best advantage in FIG. 7, that tensioners 17, 17' are examples of spiral-tightening members that threadably connect onto spiral ends but that have skirts/extensions that also extend forward, along but spaced from the outer surface of the spiral, to reach a housing member (here, shell 11, 15) to abut against a radial surface 11S, 15S of that housing member.

In FIGS. 6 and 7, it may be seen that lock nuts 23, 23' have been installed on the connector 10, to keep the nuts 31, 31' of the connector 10 locked in place to maintain spiral-unit 13 in its tightened configuration, that is, the reduced diameter, elongated configuration.

Thus, the core (one or more inner strands/wires) are connected mechanically and optionally electrically, by the inner connector 10. Thus, the outer strands are connected mechanically, and optionally electrically, via their respective spirals 21, 21' being connected to the shells 11, 15 that are connected to each other. Electrical connection, or lack thereof, between the various strands/wires may be established by selecting electrically-conductive materials, or insulating materials, respectively. Also, weight/load bearing may be accomplished by selection of materials that are strong and durable enough to bear said weight. One, but the only, application for a connector 100 may be aluminum-conductor steel-reinforced (ACSR) cable, which is known in the electrical arts and especially in the high-tension overhead electrical cable arts. In a high-tension (high-weight, for example) scenario, the inner steel strands 29 of two cables may need the strong and separate connection afforded by connector 10. The aluminum conductors 33 of the two cables are then connected by the combined left and right assemblies 150, 160 and shell 11, 15 system. Connector 100 may be utilized in scenarios other than ACSR, and the materials may be varied according to the needs of those other scenarios.

It will be understood from viewing the drawings, that the cable strand/wire ends, typically striped or otherwise uninsulated, will be slid through the various portions of the connector before the connector 10, 100 parts are connected and tightened. For example, the left and right assemblies 150, 160 and shells 11, 15 will be slid onto their respective cables C1, C2, and the inner strands 29 will be inserted through the nuts 31, 31' and into the opposing-end passageways of the spiral 13 and body 25 combination. After tightening of connector 10 with nuts 31, 31' and locking of the lock nuts 23, 23', the shells 11, 15 and assemblies 150, 160 may be connected, tightened and locked over and around the outer strands/wires 33. One may note that the outer strands/wires 33 will typically be cut to be shorter than the inner strand/wire 29, as outer strands/wires 33 need reach only through the spiral-units 21, 21', that is, they need not reach (and will typically not fit) into the connector 10. On may see from the drawings, that the diameter (inside and outer diameter) of the end spirals 21, 21' are larger than the diameter of the spiral unit 13 inside the core connector 10.

It will be understood that, in certain embodiments, insulation or sealing materials may be present inside, or added onto/around, the connector, and/or the cables or other connected members may be insulated up to the connector.

Figure 8:
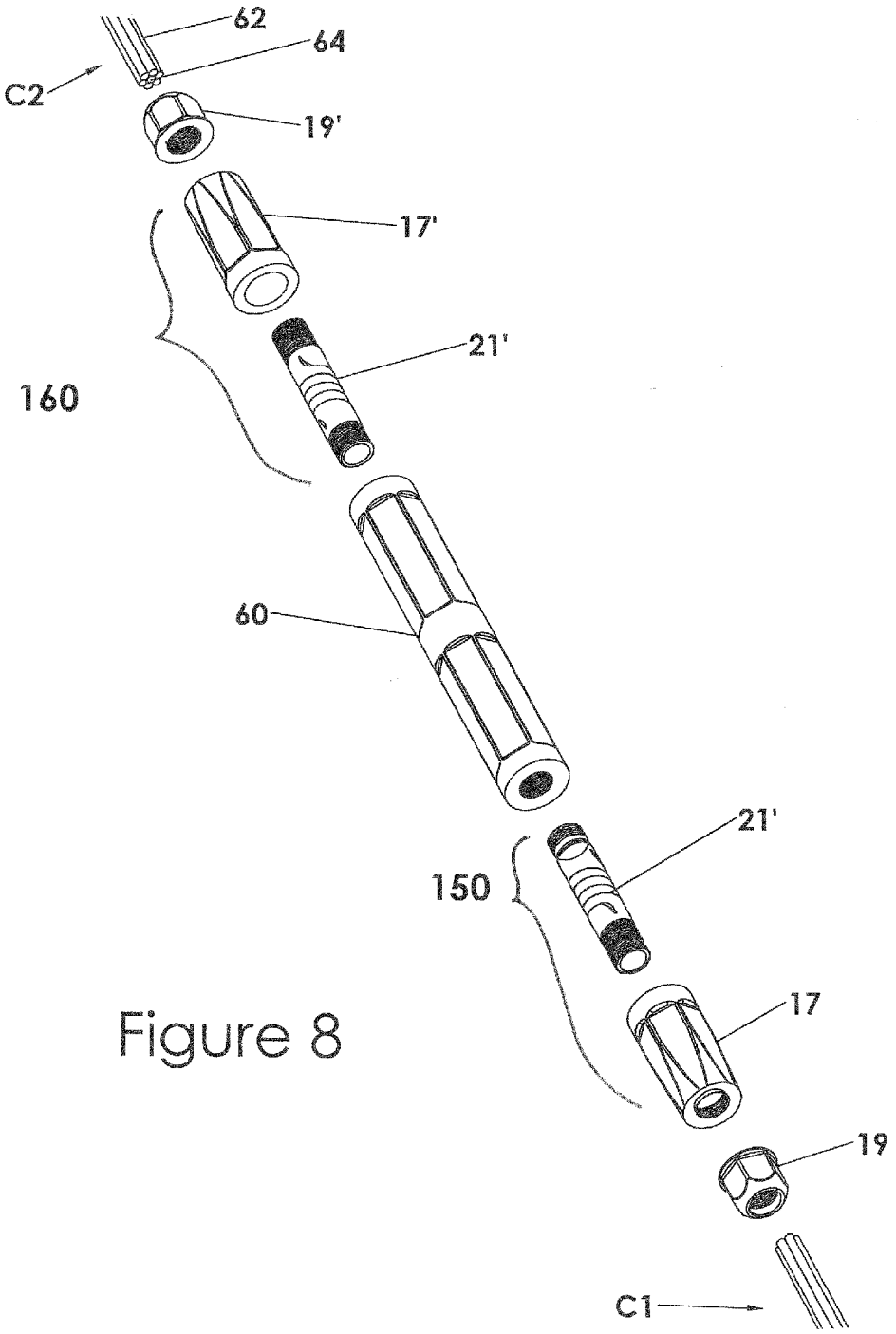
FIG. 8 is an exploded perspective view of an alternative connector that connects multi-strand cable without a supplemental core spiral-unit.
Figure 9:
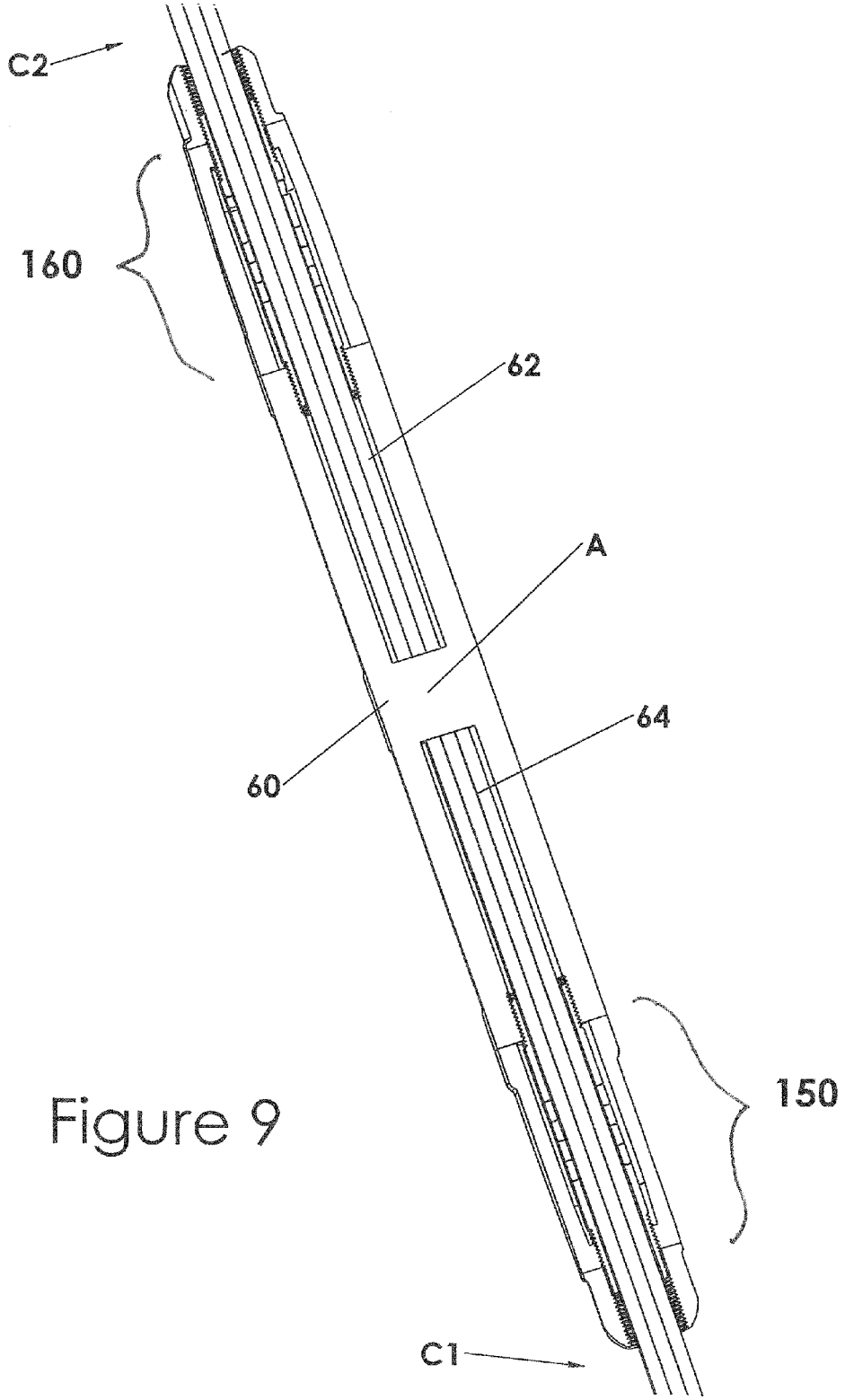
FIG. 9 is a longitudinal cross-sectional view of the connector of FIG. 8 connecting two cables, by the end tighteners pulling the end spirals axially outwardly to tighten the end spirals around their respective cables.
Figure 10:
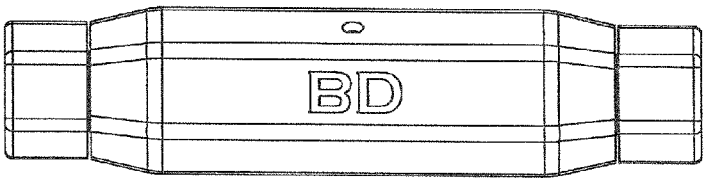
FIG. 10 is a side view of an alternative embodiment of a mechanical (and optionally also an electrical) connector.
Figure 11:
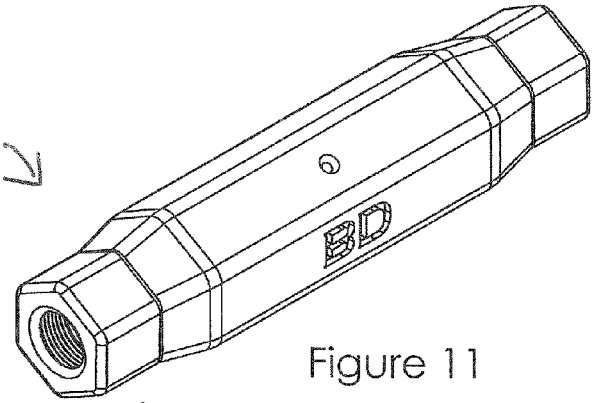
FIG. 11 is a side perspective view of the connector of FIG. 10.
Figure 12:
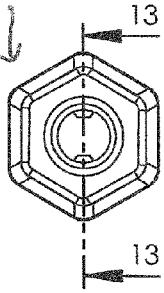
FIG. 12 is an end view of the connector of FIGS. 10 and 11.
Figure 13:
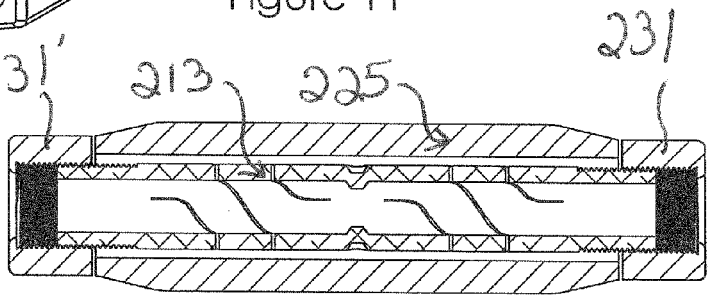
FIG. 13 is a longitudinal cross-sectional view of the connector of FIGS. 10-12, viewed along the line 13-13 in FIG. 12.

FIGS. 8 and 9 portray a connector 200 that connects all of the strands/wires of the cables C1 and C2 with the left and right connector assemblies 150, 160, without the need for a central connector. One may see in FIGS. 8 and 9 that the shell 60 is one piece, rather than two-piece, and there is no central connector 10 inside the shell 60. Inner strands/wires 64 are not connected separately from outer strands/wires 62. Instead, all strands/wires of the cables C1 and C2 are squeezed/engaged/captured by the left and right connector assemblies 150, 160 by the axial pull action provided by tensioners 17, 17' being rotated/turned inward on the spirals while abutting against the shell 60 end surfaces. This may work well in a low tension cable scenario, for example, wherein no separate, individualized connection of a core or any inner reinforcing strand is needed to support great weight. It may be seen in FIG. 9, that inner and outer strands/wires of the cables C1, C2 are all generally the same length, none being cut short as they are in FIG. 7, so that the ends of all the strands/wires meet generally at or near the middle of the shell 60, abutting against or being near location A. Note that, if the spirals of assemblies 150 and 160, and the shell 60, are electrically conductive, then all the strands/wires 62, 64 of both cables C1 and C2 are electrically connected to each other.

It may be noted that various housing and spiral-unit structure and arrangements and various inserted members, other than those detailed herein, may be used within the broad scope of the invention. For example, one may see in FIGS. 8 and 9 that the shell 60 may be considered an outer housing that connects two spirals that are distanced from each other. One could also call the shell 60 a central region of a single spiral-unit (60 plus 21 plus 21') having spiral 21 at one end and spiral 21' at the opposite end. Tensioners 17, 17' serve a similar purpose as nuts 31, 31', as they supply the force to axially-pull the spirals 21, 21' by rotating against radial abutments surfaces supplied at the end of the shell 60. Thus, threaded, ramped, slanted, cammed actuation members may engage/work-against abutment surfaces of a housing or shell, or abutment surfaces that are part of, or protruding from the central region of the spiral-unit.

FIGS. 10-30 illustrate a connector embodiment, and its preferred elements, that comprises a single spiral-unit with two spiral portions (one near each end of the spiral-unit), and tighteners at each end that abut against and rotate against transverse/radial outer end surfaces of a housing or main body of a housing. The central region of the spiral-unit is preferably pinned or otherwise fixed/secured to the main body of the housing, so that the one or more tightener can be "screwed-in" to axially-pull, its respective spiral portion outer end, outward relative to the fixed spiral region and hence tighten (reducing the inner and outer diameter of the spiral portion(s)) the tightener(s) respective spiral portion. This may be done at both ends, either sequentially in certain embodiments (by holding the main body of the housing in one's hand or with a tool), or at the same time in certain embodiments, by turning (screwing-in) both tighteners at the same time.

Figure 14:
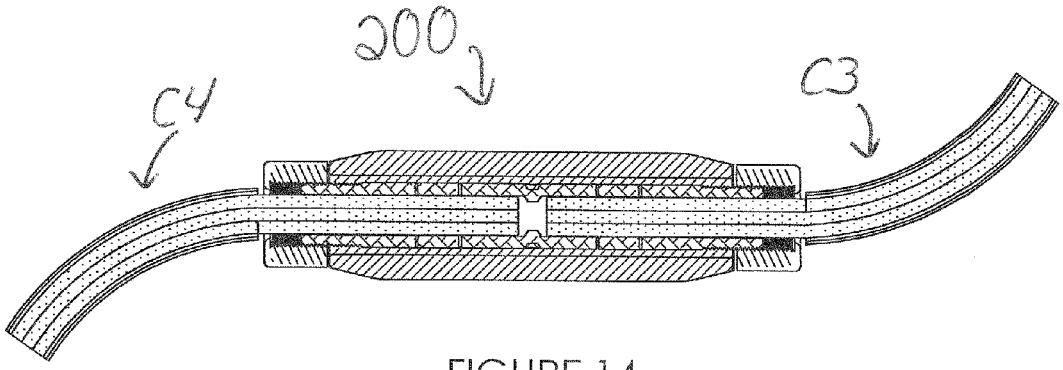
FIG. 14 is a longitudinal cross-sectional view of the connector of FIGS. 10-13, shown mechanically and electrically connecting two flexible electrical cables, wherein insulation has been stripped-off the wire ends that are inserted and captured in opposite ends of the connector by tighteners (here, nuts) pulling the ends of the spiral-unit axially outwardly to tighten the spiral coils around the wire ends.
Figure 15:
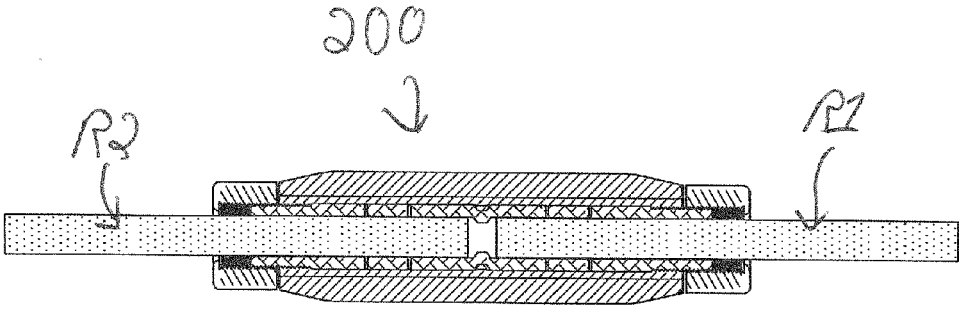
FIG. 15 is a longitudinal cross-sectional view of the connector of FIG. 10-14, shown mechanically connecting two elongated members, such as two rigid bars or rebar, wherein tighteners at each end of the connector are tightened to pull the ends of the spiral-unit axially outwardly to tighten the spiral coils around the two elongated members.
Figure 16:
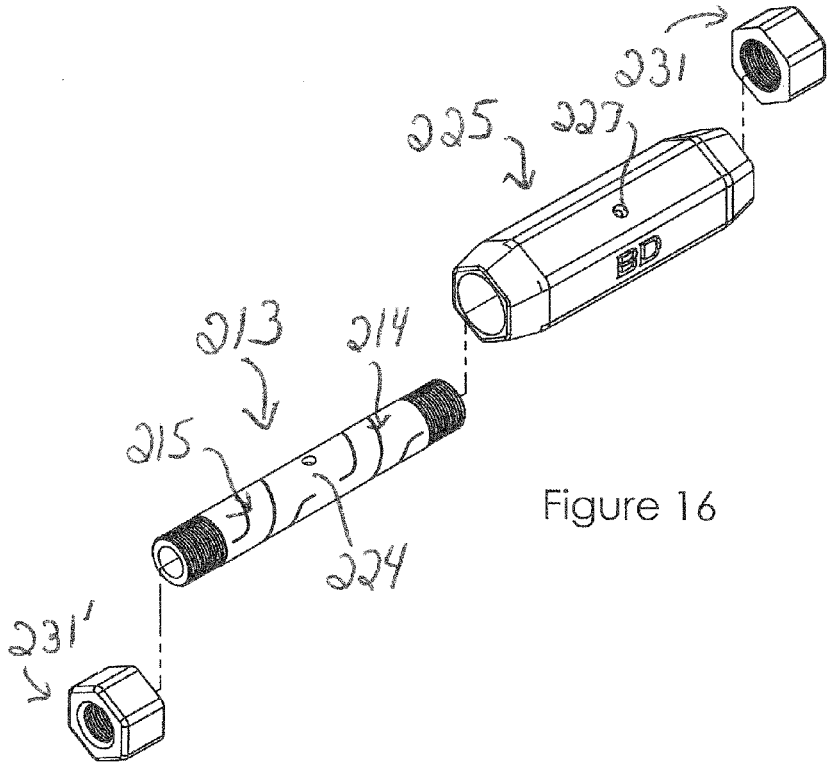
FIG. 16 is an exploded perspective view of the embodiment of FIGS. 10-15.
Figure 17:
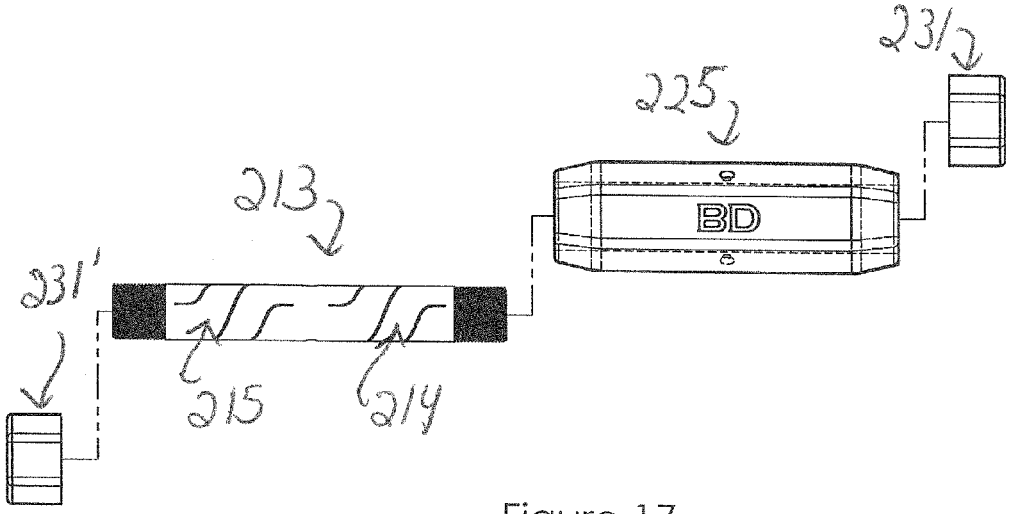
FIG. 17 is an exploded side view of the embodiment of FIGS. 10-16.
Figure 18:
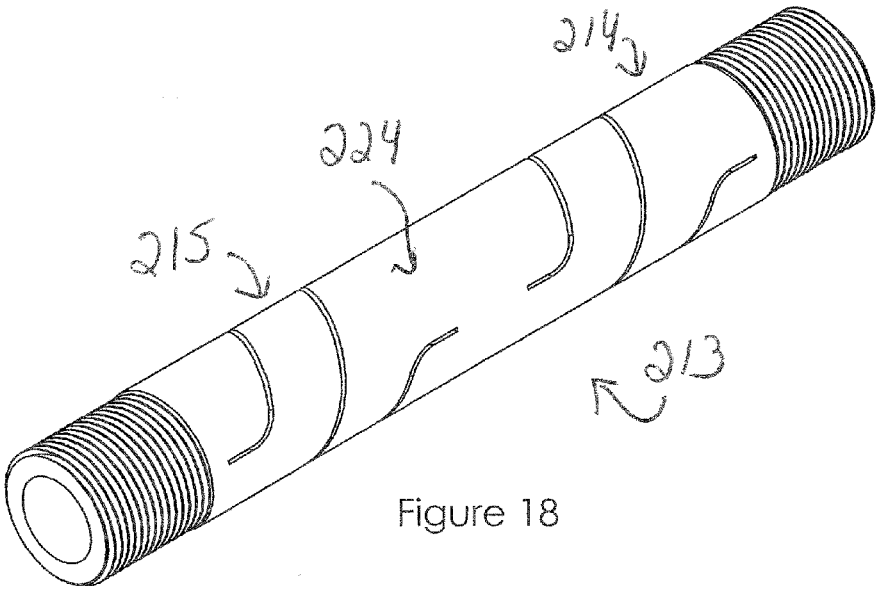
FIG. 18 is a perspective view of the spiral-unit of the embodiment of FIGS. 10-17.
Figure 19:
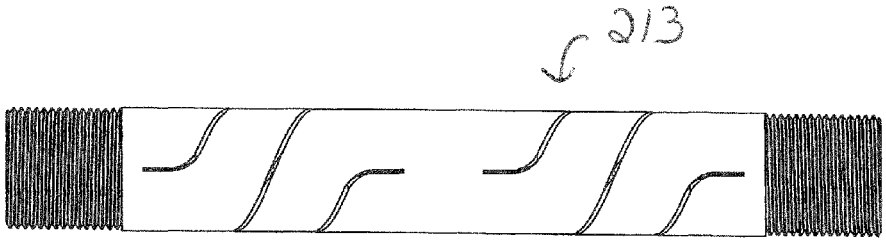
FIG. 19 is a side view of the spiral-unit of the embodiment of FIGS. 10-18.
Figure 20:
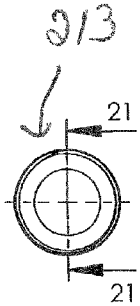
FIG. 20 is an end view of the spiral-unit of the embodiment of FIGS. 10-19.
Figure 21:
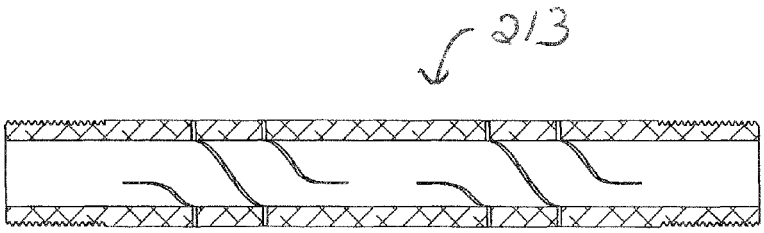
FIG. 21 is a longitudinal cross-sectional view of the spiral-unit of the embodiment of FIGS. 10-20, viewed along the line 21-21 in FIG. 20.
Figure 22:
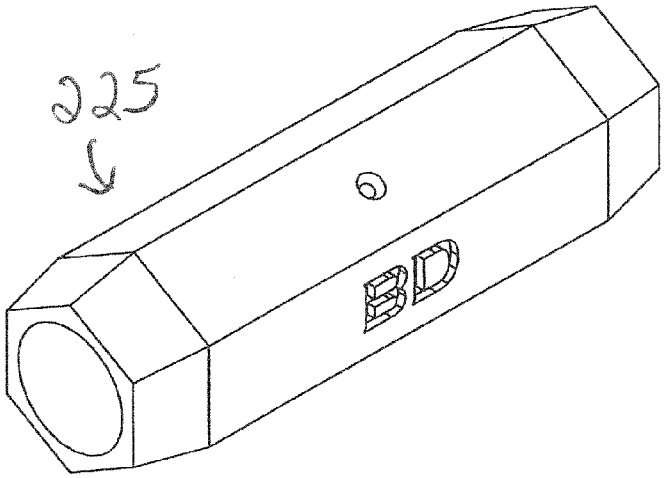
FIG. 22 is a side perspective view of the main body of the housing of the connector of FIGS. 10-21.
Figure 23:
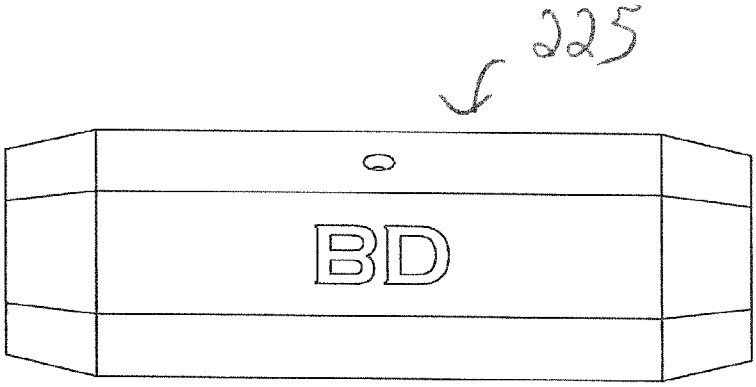
FIG. 23 is a side view of the main body of FIG. 22.
Figure 24:
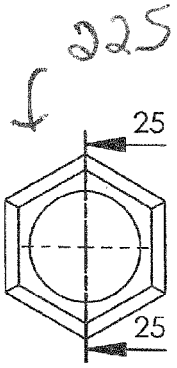
FIG. 24 is an end view of the main body of FIGS. 22 and 23.
Figure 25:
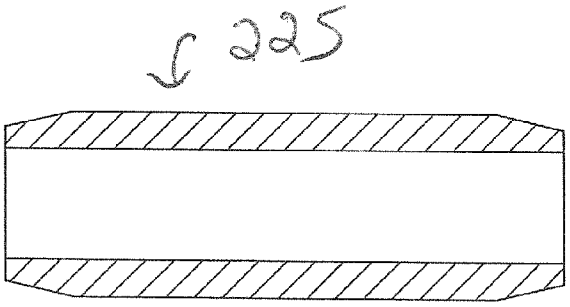
FIG. 25 is a longitudinal cross-sectional view of the main body of FIGS. 22-24, viewed along the line 25-25 of FIG. 24.
Figure 26:
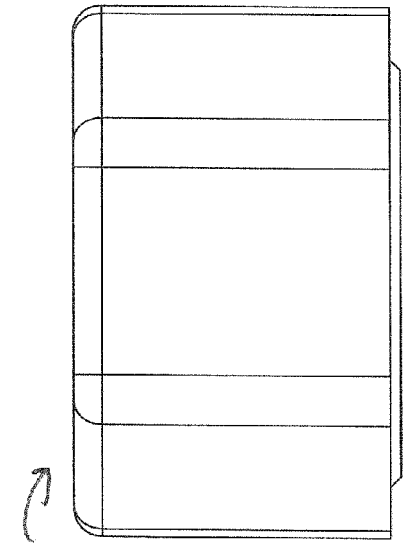
FIG. 26 is a side view of a tightener of the connector of FIGS. 10-21.
Figure 27:
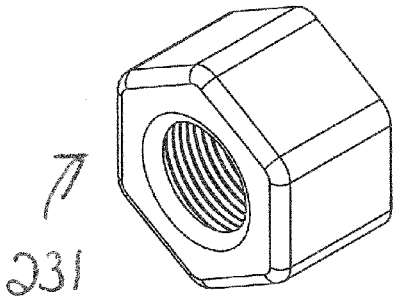
FIG. 27 is an outer-end perspective view of the tightener of FIG. 26.
Figure 28:
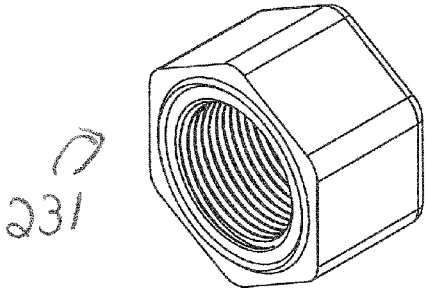
FIG. 28 is an inner-end perspective view of the tightener of FIGS. 26 and 27.
Figure 29:
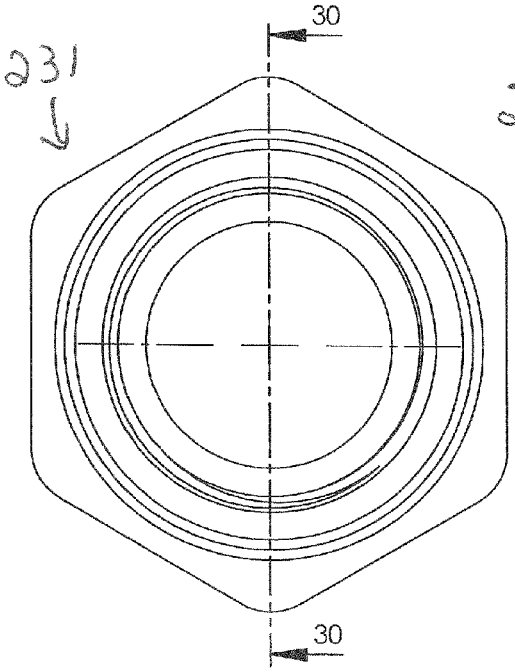
FIG. 29 is an inner-end view of the tightener of FIGS. 26-28.
Figure 30:
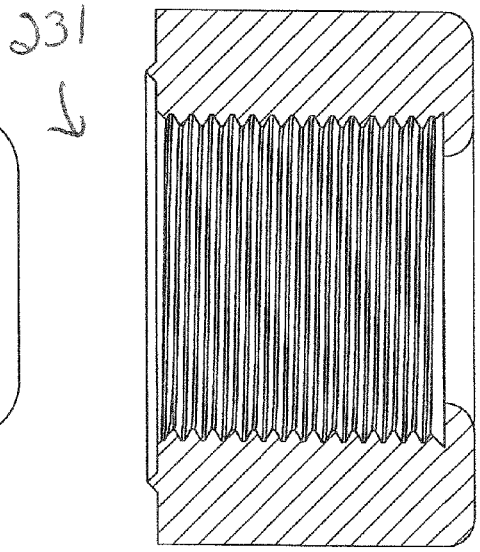
FIG. 30 is a longitudinal cross-sectional view of the tightener of FIGS. 26-29, viewed along the line 30-30 in FIG. 29.
Figure 31:
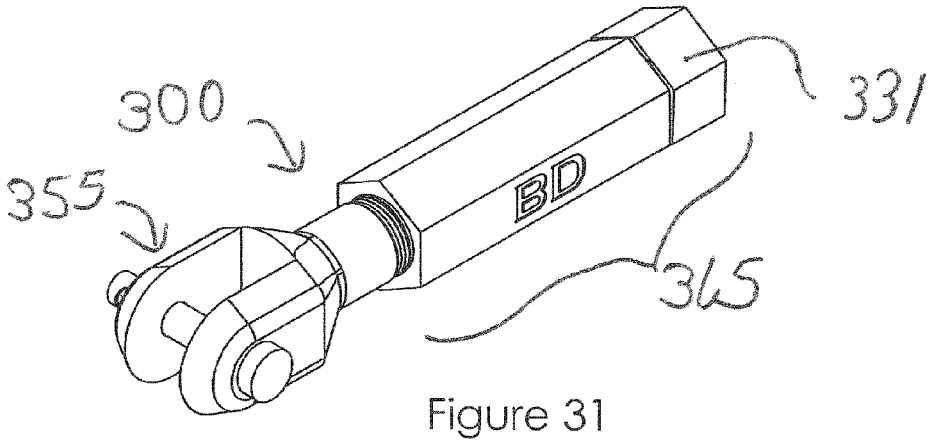
FIG. 31 is a side perspective view of an alternative axial-pull connector comprising a spiral and a tightener at one end of the connector and a fastener at the other end of the connector.
Figure 32:
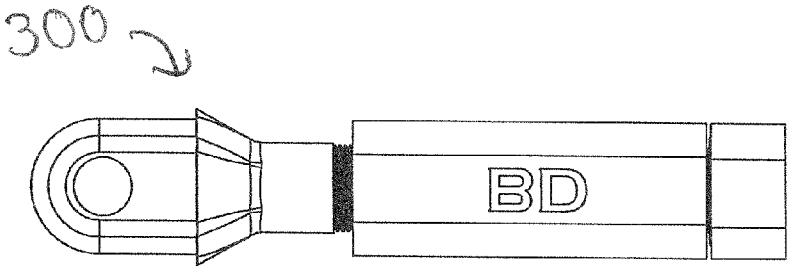
FIG. 32 is a side view of the connector of FIG. 31.
Figure 33:
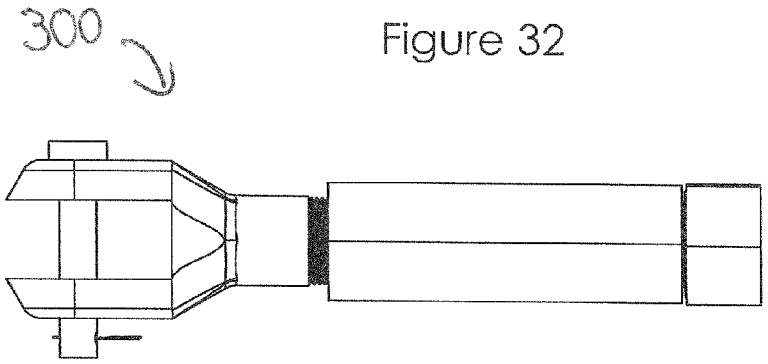
FIG. 33 is a top view of the connector of FIGS. 31 and 32.
Figure 34:
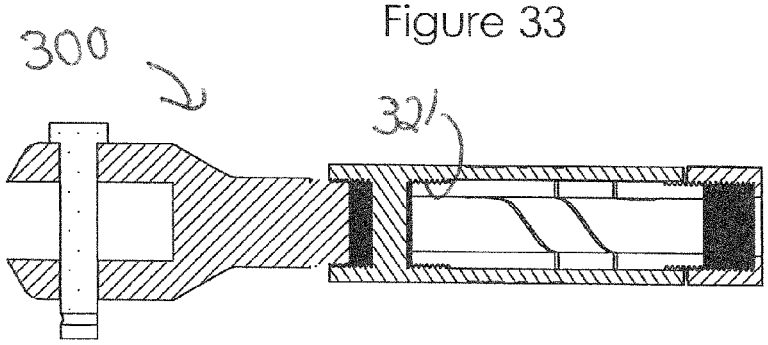
FIG. 34 is a longitudinal cross-sectional view of the connector of FIGS. 31-33.
Figure 35:
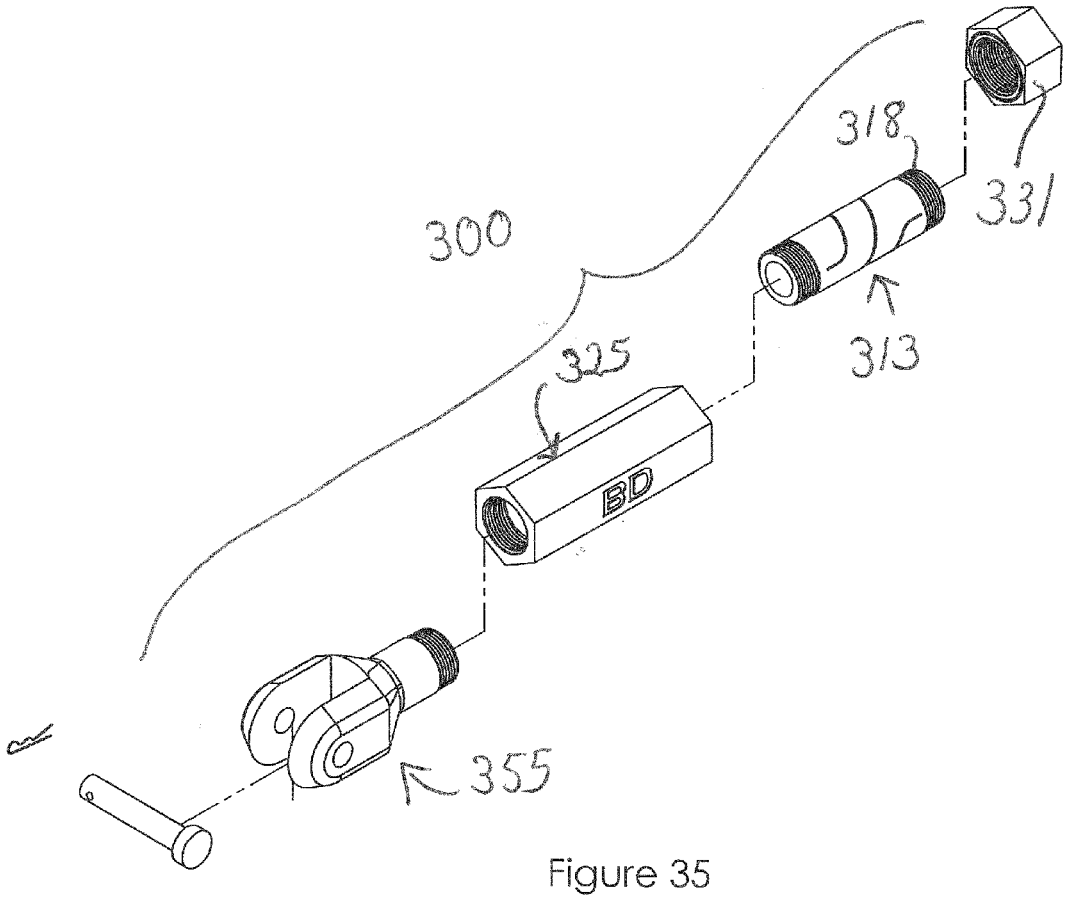
FIG. 35 is an exploded view of the connector of FIGS. 31-34.
Figure 36:
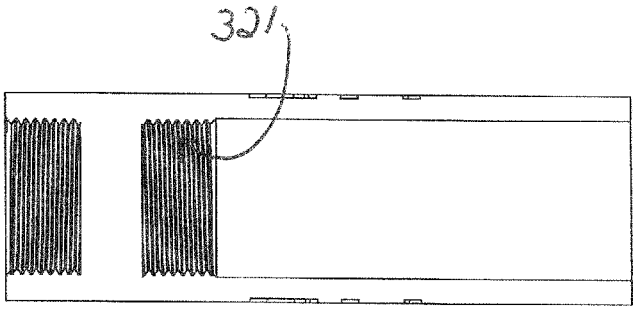
FIG. 36 is a side perspective view of the spiral housing of the connector of FIGS. 21-35.
Figure 37:
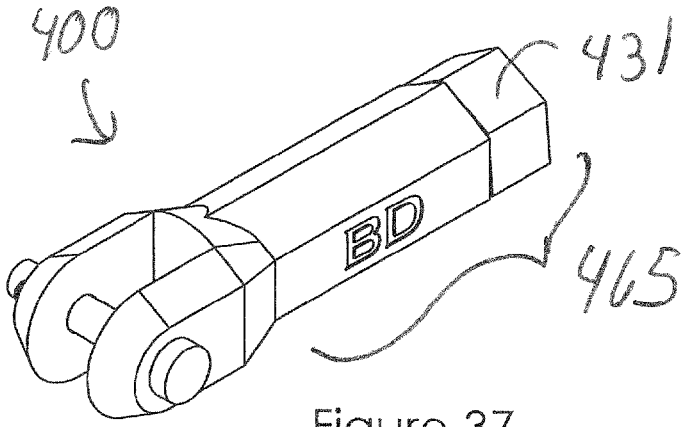
FIG. 37 is a side perspective view of an alternative axial-pull connector, similar to that of FIGS. 31-36, but wherein the fastener is integrally formed with the spiral housing.
Figure 38:
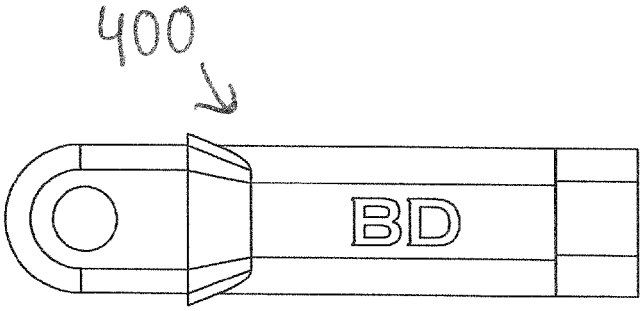
FIG. 38 is a side view of the connector of FIG. 37.
Figure 39:
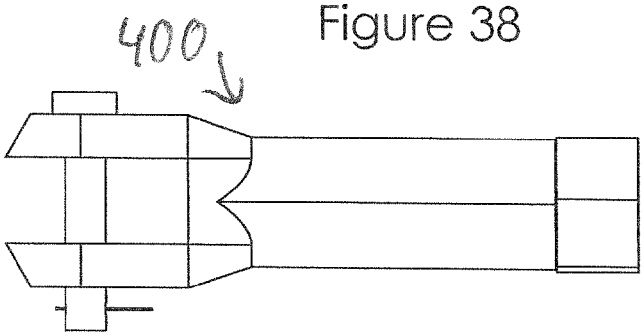
FIG. 39 is a top view of the connector of FIGS. 37 and 38.
Figure 40:
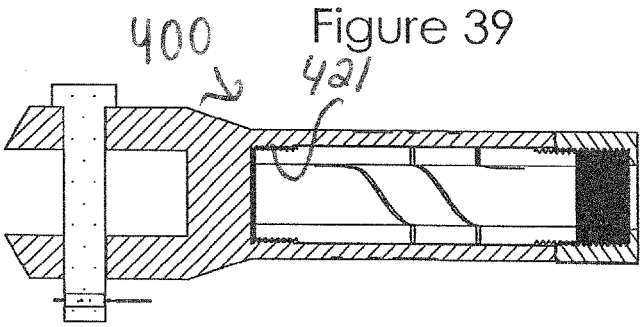
FIG. 40 is a longitudinal cross-sectional view of the connector of FIGS. 37-39.
Figure 41:
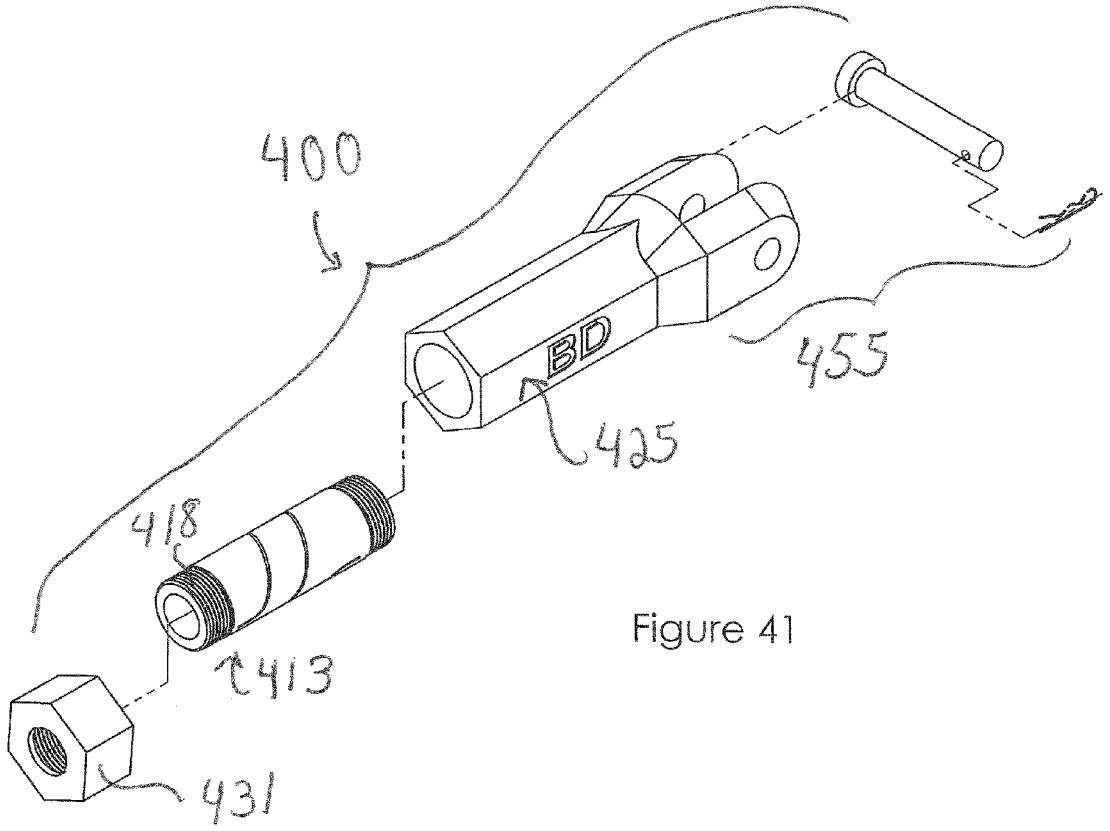
FIG. 41 is a side perspective exploded view of the connector of FIGS. 37-40.
Figure 42:
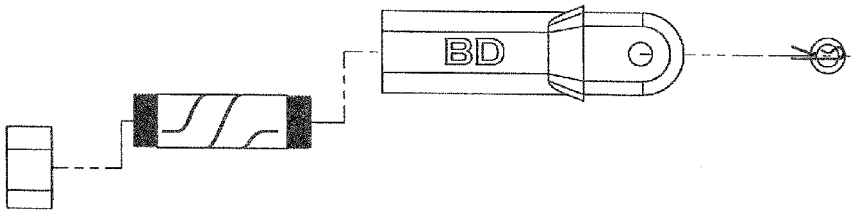
FIG. 42 is an exploded side view of the connector of FIGS. 37-41.
Figure 43:
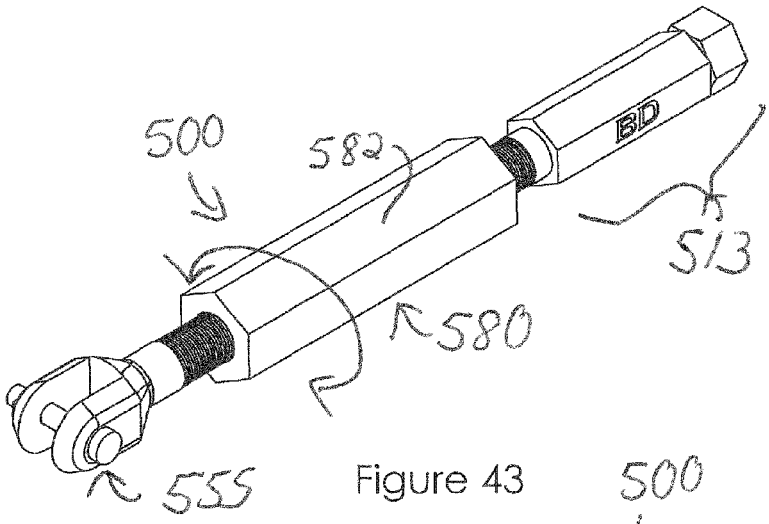
FIG. 43 is an alternative embodiment of connector that comprises an axial-pull spiral at one end (the right end in this figure), a fastener at the other end (the left end in this figure) and a turnbuckle as an embodiment of a length-adjustor in the middle.
Figure 44:
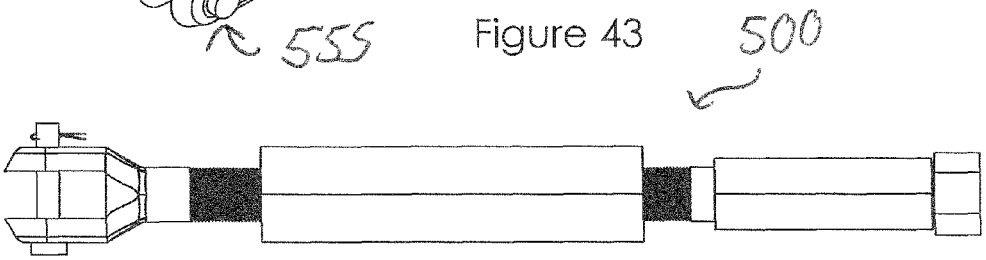
FIG. 44 is a top view of the connector of FIG. 43.
Figure 45:
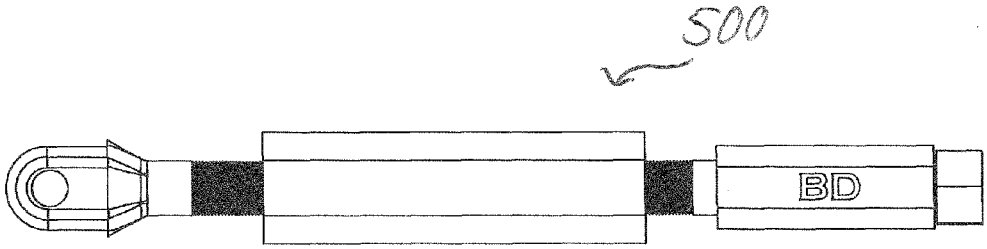
FIG. 45 is a side view of the connector of FIGS. 43 and 44.
Figure 46:
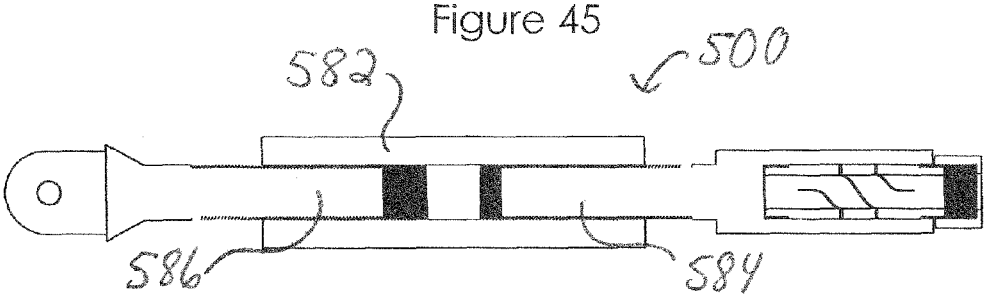
FIG. 46 is a longitudinal cross-sectional view of the connector of FIGS. 43-45.
Figure 47:
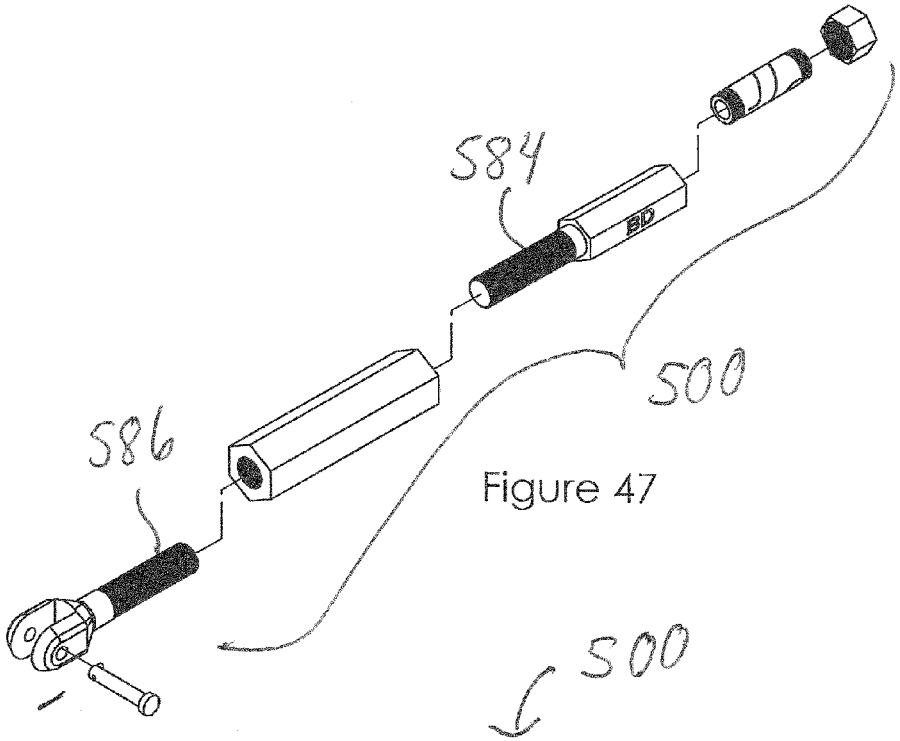
FIG. 47 is an exploded perspective view of the connector of FIGS. 43-46.
Figure 48:
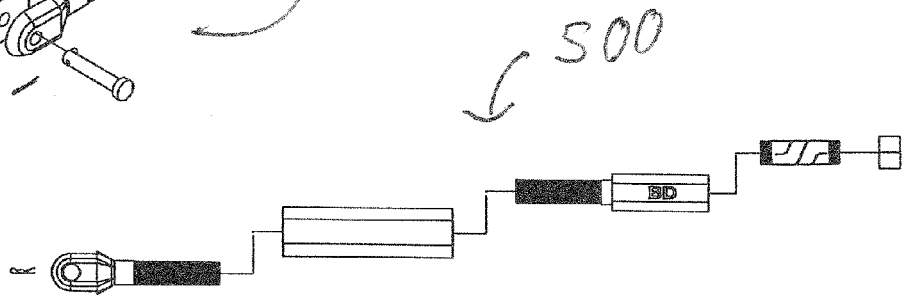
FIG. 48 is an exploded side view of the connector of FIGS. 43-47.
Figure 49:
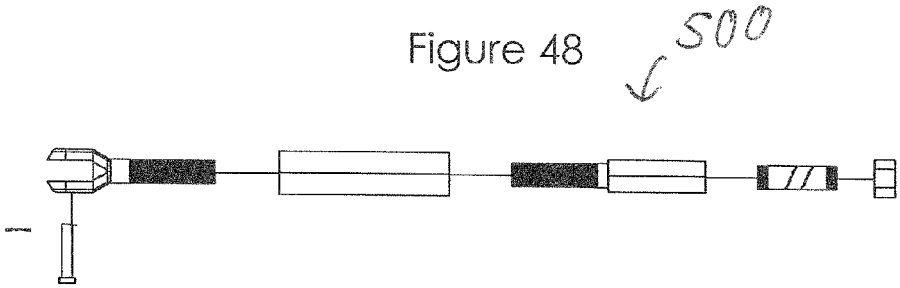
FIG. 49 is an exploded top view of the connector of FIGS. 43-48.
Figure 50:
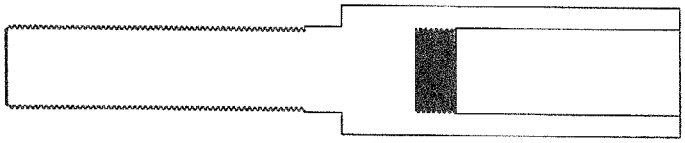
FIG. 50 is a longitudinal cross-section view of the main body of the connector of FIGS. 43-49.
Figure 51:
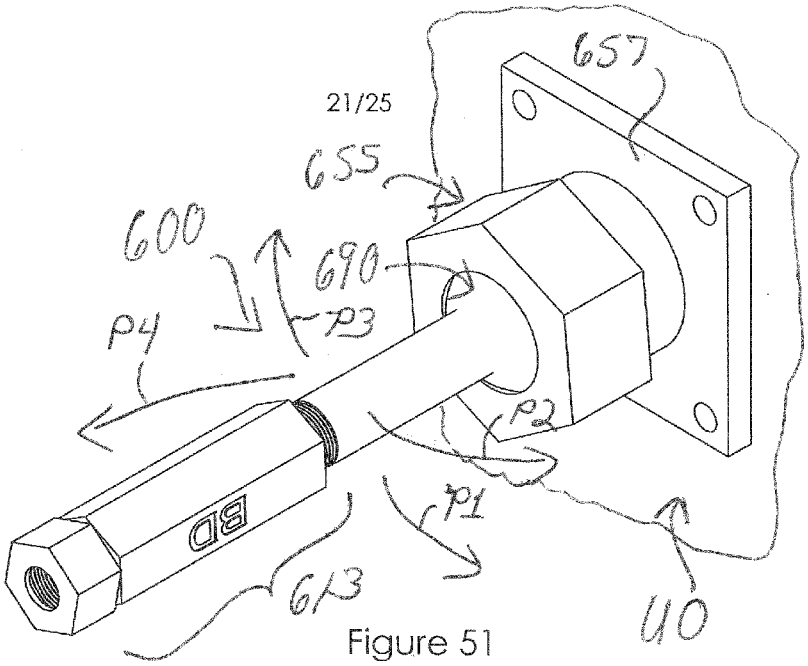
FIG. 51 is a side perspective view of an alternative connector, which comprises an axial-pull spiral connector at one end (the left end of the figure), and a ball-joint fastener at the opposite end (the right end of the figure).
Figure 52:
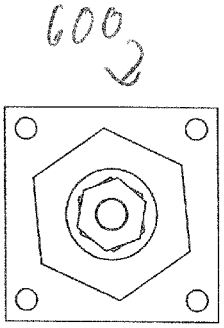
FIG. 52 is an end view of the connector of FIG. 51.
Figure 53:
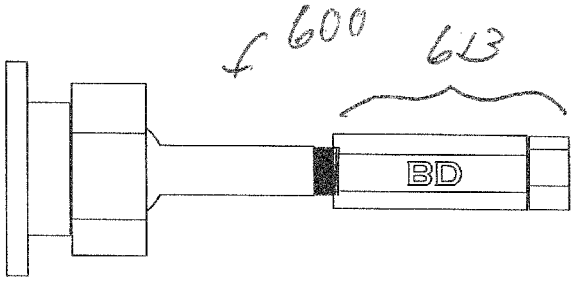
FIG. 53 is a side view of the connector of FIGS. 51 and 52.
Figure 54:
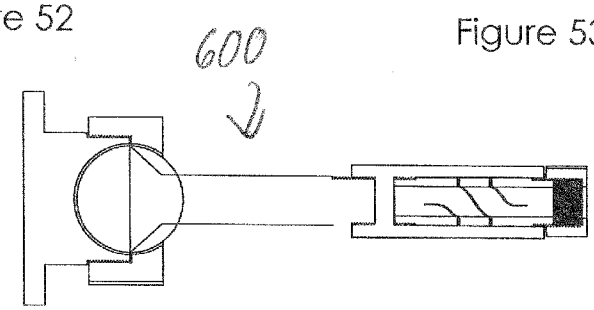
FIG. 54 is a longitudinal cross-sectional view of the connector of FIGS. 51-53.
Figure 59:
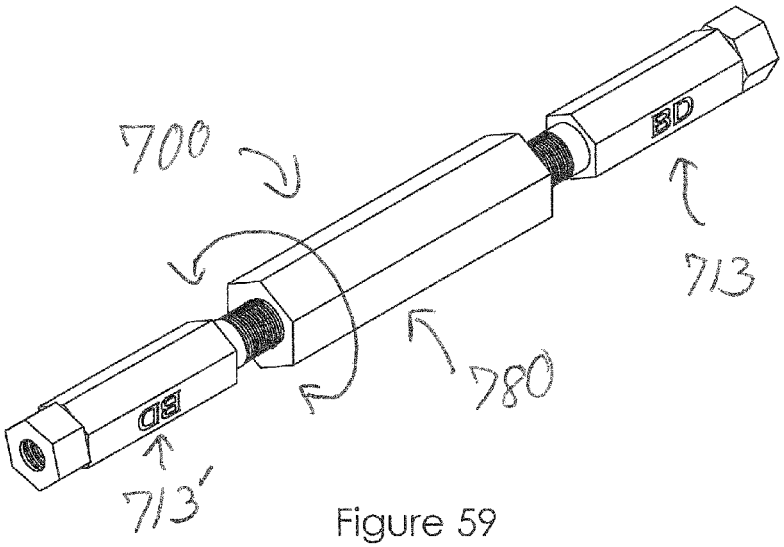
FIG. 59 is a side perspective view of another, alternative connector having two axial-pull spirals, at each end of a turnbuckle.
Figure 60:
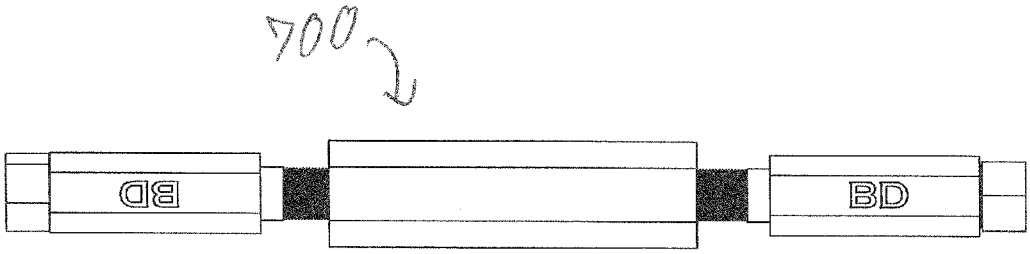
FIG. 60 is a side view of the connector of FIG. 59.
Figure 61:
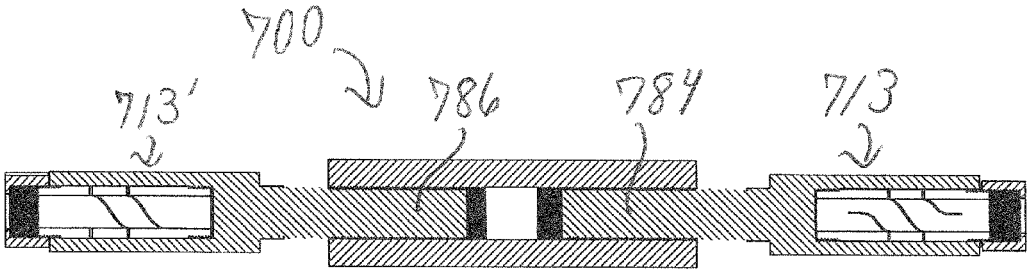
FIG. 61 is a longitudinal cross-sectional view of the connector of FIGS. 59 and 60.
Figure 62:
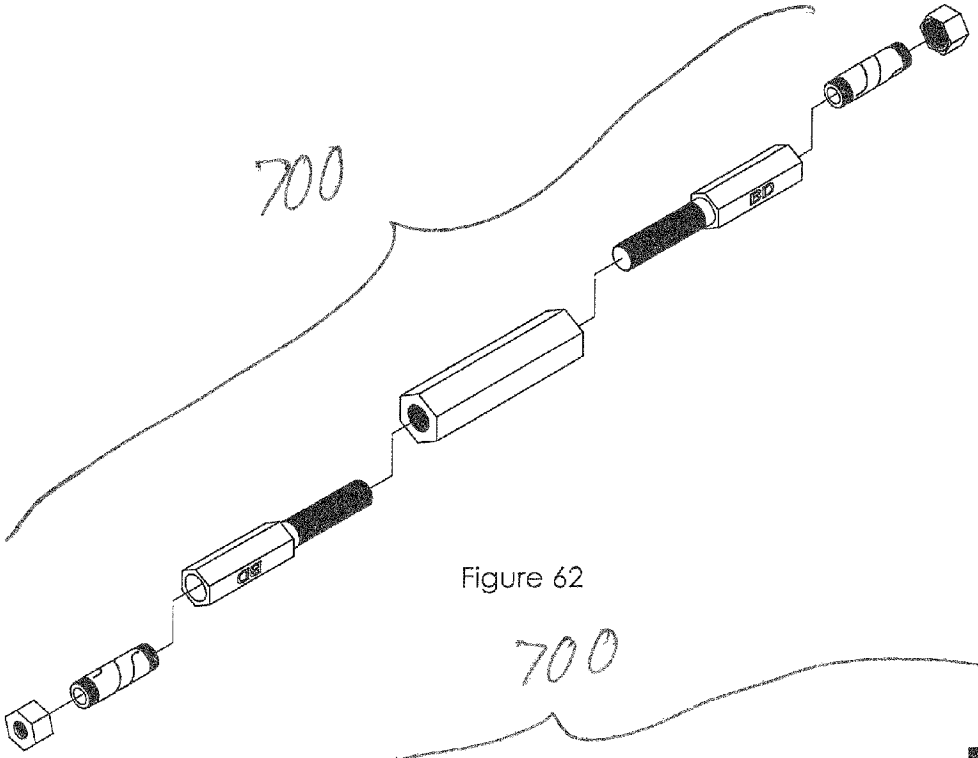
FIG. 62 is an exploded perspective view of the connector of FIGS. 59-61.
Figure 63:
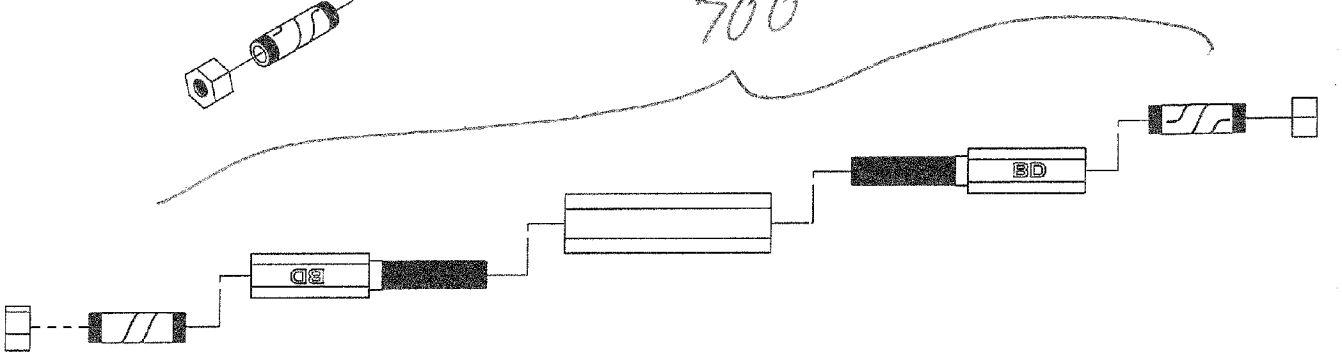
FIG. 63 is an exploded side view of the connector of FIGS. 59-62.

Specifically, FIGS. 10-30 illustrate the alternative connector 200 that has a spiral-unit 213, housing sleeve 225, and two tensioners (or "tighteners") 231, 231'. The sleeve 225 is fixed to the central portion 224 of the spiral unit 213, for example, by a rivet or pin inserted into hole 227, or other structure that prevents rotation of the central portion 224 relative to the sleeve 225. The structure and operation of this connector 200 will be understood after review of the many details of FIGS. 10-31, and of the description elsewhere in this document. As seen to best advantage in FIGS. 14 and 15, this connector 200 is an embodiment of the type having a spiral-unit internal passageway with two opposing open ends, for insertion of elongated members. In FIG. 14, flexible cables C3 and C4 are connected, by their insulation-stripped ends being inserted and captured in the passageway by tightening of the two spiral portions 214, 215 via tensioners 231, 231'. In FIG. 15, rigid bars R1, R2, for example, solid cylinders of metal such as rebar, are inserted and captured in the passageway by tightening of the two spiral portions 214, 215 via tensioners 231, 231'. Said tightening is done as described elsewhere in this document in the Summary and earlier in this Description. In FIG. 14, the cable strands and the spiral-unit will typically be electrically-conductive in order to create an electrical connection, but in alternative embodiments, the desired connection may only be mechanical, in which case the spiral would not need to be electrically-conductive. In FIG. 15, the connection would typically be mechanical only, for example, in a building or rebar-in-concrete construction environment, in which case the spiral unit would not need to be electrically-conductive or substantially electrically-conductive.

Connectors 300, 400, shown in FIGS. 31-42, and alternatives with other styles of fasteners, may be used as described elsewhere in this document. The single spiral of each connector 300, 400 will be tightened by a tightener/tensioner at one end of the connector (at one end of the spiral) that abuts against and rotates against the transverse/radial outer end surface of the housing (main body of a housing). The opposite end of the spiral-unit is preferably fixed/secured to the main body of the housing, for example, by threadably engaging the threaded inside surface of the hollow space of the main body, or by other means as may be apparent to one of skill in the art. The tightener can be "screwed-in" to axially-pull its respective spiral outer end, outward relative to the fixed inner end of the spiral, and hence tighten (reducing the inner and outer diameter of the spiral) to tighten the spiral on whatever is inserted through the axial bore of the tightener end and into the passageway of the spiral-unit. The other end of the connector is a fastener for connecting the connector (and hence the member tightened in the spiral) to another object.

More specifically, FIGS. 31-42 illustrate two connector embodiments, that is, connector 300 and connector 400, that each comprise a single spiral 313, 413 inside a housing 325, 425, and a fastener 355, 455 is provided at one end of the housed spiral combination (313 plus 325, 413 plus 425) or "spiral-based-connection unit" 365, 465. In FIGS. 31-36, the fastener 355 is threadably connected to the housing 325, so that it is removable, interchangeable with another style of fastener, may optionally be adjustable in its rotational orientation by virtue of the threaded connection. For example, fastener 355 is threadably connected to the main body of the connector so that it may be adjusted by rotation relative to the main body of the housing (threadably screwed into and out of the housing 325) for adjustment to the particular application and position of the object to which the fastener is being connected, and/or to increase tension or reduce tension on the inserted member.

In FIGS. 37-42, the fastener 455 is integrally formed with the housing 425, specifically, at an end of the housing 425. This option may be considered more permanent and less likely to come apart or fail under certain conditions. Each of these fasteners 355, 455 may be seen in the figures to be a clevis with clevis-pinfastener, but other fasteners may be substituted in certain embodiments, preferably at the closed end of the unit 365, 465. For example, an eyebolt, u-bolt, J-bolt, eyelet, clamp, or other fastener may be used, for connecting to various construction or other utilitarian objects as described elsewhere in this document.

The threaded tensioner 331, 431 is installed on the single spiral's threaded end 318, 418 that is not threadably engaged with the housing 325, 425. It may be noted that the other spiral threaded end 319, 419 threadably engages an internally-threaded region 321, 421 in the hollow space of the housing 325, 425, whereby the spiral is held in the housing and fixed to the housing at least as long as the spiral is not rotated in a direction that will unscrew the end 319, 419 from the housing. One may understand that, if the threads on both ends of the spiral and on the tensioner 331, 431 are the same handedness, for example, all right-handed, then screwing-on the tensioner 331, 431 will axially-pull end 318, 418 outward as desired and will unlikely unscrew the spiral from its threaded connection to the region 321, 421.

FIGS. 43-50 portray an alternative embodiments of connector 500, which includes a spiral connector 513 at one end (the right end in FIG. 43), a fastener 555 (such as fastener 355 in FIGS. 31-36 or another fastener as will be understood by the discussion above regarding FIGS. 31-42), and a turnbuckle 580 in between the spiral connector 513 and the fastener 555. The spiral connector 513 will operate as understood from the teachings elsewhere in this document and the drawings. Also, the fastener or an alternative fastener, such as an eyebolt, u-bolt, J-bolt, eyelet, clamp, or other fastener, will be understood to be for connecting to various construction or other utilitarian objects as described elsewhere in this document. The turnbuckle 580 may work like a conventional turnbuckle structure. The user may turn (rotate) the internally-threaded turnbuckle sleeve 582 in a first direction relative to the two threaded shafts 584, 586 that extend from the spiral connector housing and the fastener, respectively, and that threadably engage the sleeve 582, whereby both shafts are pulled inward farther into the sleeve 582. This first direction turning, therefore, adjusts the connector as a whole by tensioning it due to shortening. Or, by turning (rotating) the sleeve 582 in the second, opposite direction relative to the shafts 584, 586, the shafts will move outward in the sleeve 582, thereby adjusting the connector as a whole by releasing tension due to lengthening of the connector as a whole.

FIGS. 51-58 portray an alternative connector 600, which includes a spiral connector 613 at one end (the left end in FIG. 51), a fastener 655 at the opposite end, which fastener 655 includes a ball-joint 690 as an embodiment of an adjustment system. The spiral connector 613 will operate as understood from the teachings elsewhere in this document and the drawings. The fastener 655 comprises a plate 657 for attachment to a wall, post, or other surface of a construction or utilitarian object UO, as described elsewhere in this document. The ball-joint 690 allows the ball 692 and the shaft 694 extending from the ball 692, to be pivot/swivel relative to the threaded ball-retainer 696 and the concave or generally-semi-spherical ball socket 698, hence, pivoting/swiveling the spiral connector 613. This allows swivelable/pivotable connection to a wall, post, or other anchor surface by means of the ball-joint and plate. Using such a connector, or alternative embodiments with other swivelable/pivotable fasteners, the connector may be installed in various applications and structures, with the longitudinal axis being pivoted/swiveled (or "swung") to various directions/angles (see arrows P1, P2, P3, and P4), for example, various angles that are non-perpendicular to the plate of the connector and the anchor surface to which the plate is attached. Depending on the dimensions and tolerances of the design, the ball-retainer 696 may tighten so tight on the threaded socket 698 that the ball member is locked at a particular orientation/angle after said tightening of the ball-retainer 696. Or, the design may allow for ongoing movement of the ball 692 in the socket 698 if desired to accommodate vibrations, expansion or contraction in said utilitarian object UO, and/or other forces.

FIGS. 59-63 illustrate another embodiment, connector 700, which comprises two spiral connection units 713, 713' at opposite ends of the connector 700, and a turnbuckle 780 including a turnbuckle sleeve, which adjustably connecting the two units 713, 713'. Each of the units 713, 713' comprises a housing with a threaded shaft 784, 786 extending to, and threadably engaging the internally-threaded turnbuckle sleeve 782. Thus, inserted members may be captured in each spiral connection unit 713, 713', and the turnbuckle between the units 713, 713' serves to lengthen or shorten the overall length of the connector (the connector as a whole), thus pulling the inserted members together or pushing them apart as needed, for tensioning or lessening of tension as desired. Included in the broad category of turnbuckle structure may be adjustors called "stretching screw" or "bottle screw" and therefore, certain embodiments may include various stretching screws or bottle screws for adjustment.

Figure 64:
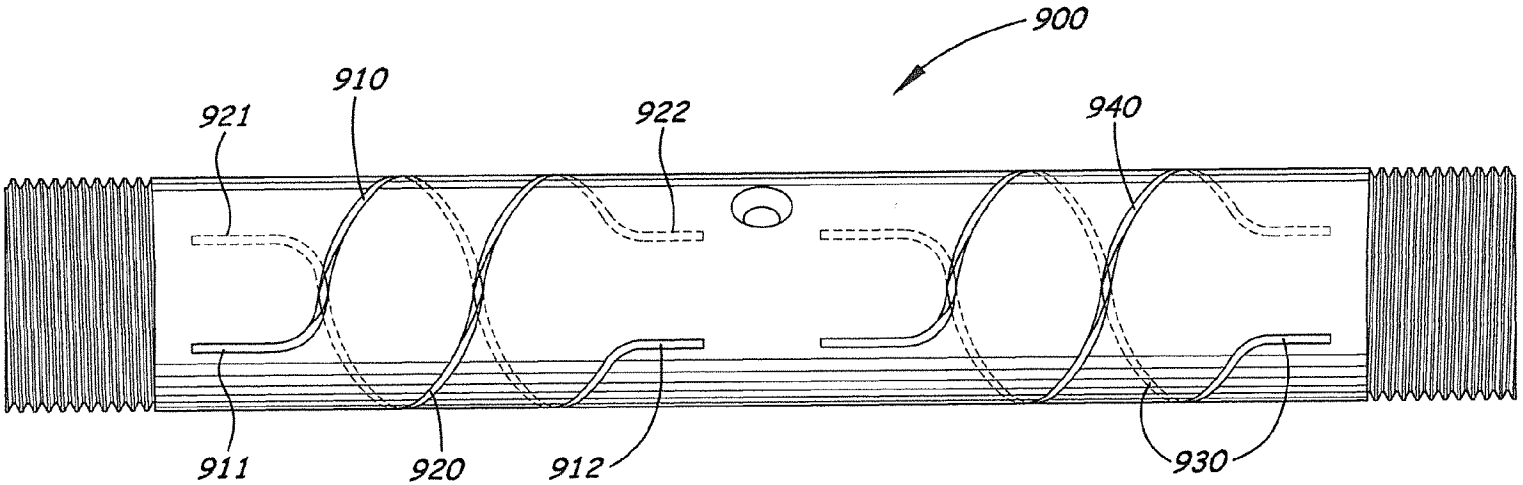
FIG. 64 is a side view of an example of a spiral-unit, with dual-spiral portions at/near each end, and a central region with a pin hole that may be used to fix the central region to a main body of a housing, for example, if desired for certain embodiments of connectors.

FIG. 64 shows an example of a "dual" spiral cut/formation that has been found to be particularly beneficial for the connectors of this disclosure. FIG. 64 is a side view of an example of a spiral-unit 900, with spiral portions at/near each end, and a central region with a pin hole that may be used to fix the central region to a main body of a housing, for example, if desired for certain embodiments of connectors. Note that the preferred spiral cuts/formations of each spiral portion comprise (or consisting of or consisting essentially of) multiple spiral cuts that extend around the spiral tubular structure spaced from each other. For example, two spiral cuts 910, 920 extend around the spiral tubular structure, for example, about 180 degrees from each other. This results, for example, in the two spiral cuts 910, 920 at their left ends 911, 921 starting with one facing the viewer and one hidden behind the spiral tube (in dashed lines). The two spiral cuts then spiral around the spiral tube in this pattern and end in a similar, spaced apart relationship (about 180 degrees preferably) near the central region, wherein the right ends 912, 922 are likewise visible and hidden, respectively. The spiral cuts 930, 940 at the right end of the spiral-unit 900 are similarly provided, orientated and spaced. This type of spiral spacing is believed to improve spiral coil movement smoothness, reliability, predictability, and effectiveness. This "dual-spiral", preferably for each spiral portion, is believed to be especially beneficial (smoother, reliable, predictable, and effective) in view of the spiral portions being pulled preferably axially straight outward, so that the forces are applied to the two spirals circling in spaced relationship.

In certain embodiments, therefore, the invention may be described as: a connector comprising:

- a spiral connector (also a "first spiral connector") comprising:
  - a spiral having an internal passageway and the spiral being movable from a relaxed configuration having a relaxed diameter of said passageway to a tightened configuration having a tightened diameter of said passageway that is smaller than said relaxed diameter;
  - multiple elongated members inserted into said spiral;
  - a housing connected to the spiral and adapted to tighten the spiral to said tightened configuration so that said elongated members are retained in the passageway;
  - wherein the housing is adapted to tighten the spiral by comprising a housing sleeve extending around the spiral and fixed to a securement region of the spiral, and a tensioner threadably engaged with a threaded region of the spiral, wherein rotation of the tensioner, relative to the threaded region of the spiral, toward the housing sleeve and with the tensioner abutting against the housing sleeve, pulls the threaded region of the spiral axially away from said securement region of the spiral to axially-lengthen the spiral and tighten the spiral into said tightened configuration.

The spiral may have a second threaded region and the housing may further comprise a second tensioner threadably engaging said second threaded region for tightening the spiral near said second threaded region. The tensioner may comprise a bore for insertion of the elongated members into the spiral, and the housing sleeve may comprise an open end for axially-pulling the threaded region of the spiral out of the housing sleeve. The connector may further comprise a fastener connected to the housing sleeve for connecting the housing sleeve to a construction or utilitarian object, and in certain embodiments, may also comprise a turnbuckle between the housing sleeve and the fastener adapted to lengthen or shorten the connector. The connector may, and preferably does, comprise a latch system for retaining said tensioner in a position wherein said spiral is in the tightened configuration, for example, so that vibration or other forces do not accidently loosen the tensioner and spiral. Said latch system may comprise the tensioner being forced against the housing sleeve to prevent the tensioner from rotating in a direction that loosens the spiral to said relaxed configuration, for example, by spring-resilience of the spiral. And/or, said latch system may comprise a lock-nut or other tensioner-retainer or tensioner-latch, for example, a lock-nut threadably installed on the threaded region of the spiral with the tensioner between the housing sleeve and the lock-nut, wherein the lock-nut is threadably tightened against the tensioner to prevent the tensioner from rotating in a direction that loosens the spiral to said relaxed configuration.

The spiral described in the immediately-preceding paragraph may be a "spiral-unit" comprising two spiral portions at or near opposite ends of the spiral unit (typically, shaped generally like a tube cut/provided with spiral coils) and said securement region of the spiral is in between the two spiral portions, for example, a central region/portion of the spiral unit. Therefore, the elongated members may be inserted into opposite open ends of the spiral. Or, the elongated members may be inserted into a single end of the two-ended spiral unit. A second spiral connector may be provided (in addition to said spiral connector of the immediately preceding paragraph, or a "second spiral connector") and a turnbuckle between the two spiral connectors.

There may be a fastener connected to the housing sleeve for connecting the housing sleeve (and hence connecting the spiral connector of the two immediately-preceding paragraphs) to a construction or utilitarian object, and a pivot system to pivot the spiral connector to various positions relative to the fastener, for adjusting the angle of the spiral connector longitudinal axis relative to said construction or utilitarian object. This may be important for example, to place the spiral connector at a downwardly-extending angle relative to a vertical wall or post, for example.

The spiral of the connector as described in the three immediately-preceding paragraphs may be electrically-conductive and may be used with elongated members that are electrically-conductive so the elongated members are electrically-connected to the spiral and to each other. Any of the spirals in the three immediately-preceding paragraphs may be formed by two spiral cuts circling a tube 180 degrees apart from each other, for example. Also, the connectors of any of the three immediately-preceding paragraphs may further be described as: wherein the elongated members are core members of a first multi-layered cable and a second multi-layered cable, and the spiral is a core-connection spiral wherein the core members of said first and second cables extend into opposite ends of, and are captured in the spiral when the spiral is tightened, and wherein the connector further comprises a first end spiral and a second end spiral near first and second ends of said core-connection spiral, wherein said first and second end spirals are each adapted to capture outer strands of the first and second cables respectively, and wherein the connector further comprises an outer sleeve system that extends around and along the housing sleeve associated with the core-connection spiral to connect the first and second end spirals.

Alternative ways of describing the preferred embodiments may be as follows. The connector may be a mechanical and/or electrical connector includes elements for axially-pulling an end of a hollow connector to tighten at least a portion of the connector, by lengthening the connector and reducing diameter(s) in at least a portion of the connector. Threaded, ramped, slanted, or cammed structures may be used, for example, to directly or indirectly provide the force needed to axially-pull the connector. In the tightened configuration, the connector grips/squeezes, and therefore retains/captures/locks one or more members inside its hollow passageway. Thus, member(s) are connected to each other, and/or connected to member(s) installed in an opposite end of the connector, and/or connected to a terminal or other object attached to the connector (for example, a terminal at the opposite end of the connector). This axial-pull system may be used to connect ends of strands, wires, cables, bars, rods, straps, or other members, for example, re-bar, ACSR cables, or other elongated members. The preferred method comprises installing the members to be connected in the open end(s) of a spiral(s) of the connector and rotating/twisting threaded actuation member(s) onto threaded end(s) of the spiral(s), wherein, when the threaded actuation member(s) reach(es) a housing stop/limit, the continued rotational movement of the threaded actuation member relative to the threaded spiral pulls the spiral outward in the axial direction. Preferably, no set screws/bolts and no crimping mechanisms are used to hold the member in the passageway, but the connector may comprise or be connected to a fastener, pivot-joint, ball-joint, turnbuckle or other device for connection and/or adjustment and/or tensioning relative to a wall, tower, or other member to which the connector is attached or connected in construction or utility applications.

Although this invention has been described in this document and in the drawings with reference to particular means, materials and embodiments, it is to be understood that the invention is not limited to these disclosed particulars, but extends instead to all equivalents within the broad scope of the following claims.

The invention claimed is:

1. A connector comprising:

a spiral connector comprising:

a spiral having an internal passageway and the spiral being movable from a relaxed configuration having a relaxed diameter of said passageway to a tightened configuration having a tightened diameter of said passageway that is smaller than said relaxed diameter;

multiple elongated members inserted into said spiral;

a housing connected to the spiral and adapted to tighten the spiral to said tightened configuration so that said elongated members are retained in the passageway;

wherein the housing is adapted to tighten the spiral by comprising a housing sleeve extending around the spiral and fixed to a securement region of the spiral, and a tensioner threadably engaged with a threaded region of the spiral, wherein rotation of the tensioner, relative to the threaded region of the spiral, toward the housing sleeve and with the tensioner abutting against the housing sleeve, pulls the threaded region of the spiral axially away from said securement region of the spiral to axially-lengthen the spiral and tighten the spiral into said tightened configuration.

2. The connector as in claim 1, wherein the spiral has a second threaded region and the housing further comprises a second tensioner threadably engaging said second threaded region for tightening the spiral near said second threaded region.

3. The connector as in claim 1, wherein the tensioner comprises a bore for insertion of the elongated members into the spiral, and the housing sleeve comprises an open end for axially-pulling the threaded region of the spiral out of the housing sleeve.

4. The connector as in claim 1, further comprising a fastener connected to the housing sleeve for connecting the housing sleeve to a construction or utilitarian object.

5. The connector as in claim 4, further comprising a turnbuckle between the housing sleeve and the fastener adapted to lengthen or shorten the connector.

6. The connector as in claim 1, wherein said housing comprise a latch system for retaining said tensioner in a position wherein said spiral is in the tightened configuration, and wherein said latch system comprises the tensioner being forced against the housing sleeve to prevent the tensioner from rotating in a direction that loosens the spiral to said relaxed configuration.

7. The connector as in claim 1, wherein said housing comprise a latch system for retaining said housing in a position wherein said spiral is in the tightened configuration, and wherein said latch system comprises a lock-nut threadably installed on the threaded region of the spiral with the tensioner between the housing sleeve and the lock-nut, wherein the lock-nut is threadably tightened against the tensioner to prevent the tensioner from rotating in a direction that loosens the spiral to said relaxed configuration.

8. The connector of claim 1, wherein said spiral comprises two spiral portions at or near opposite ends of a tube and said securement region of the spiral is in between the two spiral portions.

9. The connector of claim 8, wherein the elongated members are inserted into opposite open ends of the spiral.

10. The connector of claim 1, wherein the elongated members are inserted into a single end of the spiral.

11. The connector of claim 1, comprising a second spiral connector and a turnbuckle between the two spiral connectors.

12. The connector of claim 1, further comprising a fastener connected to the housing sleeve for connecting the housing sleeve to a construction or utilitarian object, and a pivot system to pivot the spiral connector to various positions relative to the fastener, for adjusting the angle of the spiral connector longitudinal axis relative to said construction or utilitarian object.

13. The connector of claim 1, wherein said spiral and said elongated members are electrically-conductive so the elongated members are electrically-connected to the spiral and to each other.

14. The connector of claim 1, wherein the spiral is formed by two spiral cuts circling a tube 180 degrees apart from each other.

15. The connector of claim 1, wherein the elongated members are core members of a first multi-layered cable and core members of a second multi-layered cable, and the spiral is a core-connection spiral wherein the core members of said first and second multi-layered cables extend into opposite ends of, and are captured in the spiral when the spiral is tightened, and wherein the connector further comprises a first end spiral and a second end spiral near first and second ends of said core-connection spiral, wherein said first and second end spirals are each adapted to capture outer strands of the first and second multi-layered cables respectively, and wherein the connector further comprises an outer sleeve system that extends around and along the housing sleeve associated with the core-connection spiral to connect the first and second end spirals.

16. A connector comprising:

a spiral having a longitudinal axis and an internal passageway, the spiral being movable from a relaxed configuration having a relaxed diameter of said internal passageway to a tightened configuration having a tightened diameter of said internal passageway that is smaller than said relaxed diameter;

multiple elongated members inserted into said spiral; and a housing comprising a housing sleeve connected to a securement region of the spiral and a first tensioner threadably connected to a first threaded region of the spiral, the housing being adapted to tighten the spiral to said tightened configuration by the first tensioner being rotatable on the first threaded region while the first tensioner abuts against the housing sleeve, to pull the first threaded region axially away from the housing sleeve and the securement region to pull the spiral into the tightened configuration to retain said elongated members in the internal passageway.

17. The connector as in claim 16, wherein the tensioner comprises a bore for insertion of the elongated members into the spiral, and the housing sleeve comprises an open end for axially-pulling the threaded region of the spiral out of the housing sleeve.

18. The connector as in claim 16, further comprising a latch system for retaining said tensioner in a position wherein said spiral is in the tightened configuration, and wherein said latch system is selected from a group consisting of the tensioner being forced against the housing sleeve to prevent the tensioner from rotating in a direction that loosens the spiral to said relaxed configuration, and a lock-nut threadably installed on the threaded region of the spiral with the tensioner between the housing sleeve and the lock-nut wherein the lock-nut is threadably tightened against the tensioner to prevent the tensioner from rotating in a direction that loosens the spiral to said relaxed configuration.

19. The connector of claim 16, wherein said spiral and said elongated members are electrically-conductive so the elongated members are electrically-connected to the spiral and to each other.

20. A connector comprising:

a tubular spiral unit having a central securement region, and a first end and an opposite second end, each of the first end and the second end comprising spiral coils and a threaded region, the spiral unit having a longitudinal axis and an internal passageway and being movable from a relaxed configuration having a relaxed diameter of said internal passageway to a tightened configuration having a tightened diameter of said internal passageway that is smaller than said relaxed diameter;

multiple elongated members inserted into said internal passageway; and a housing being adapted to tighten the spiral unit to said tightened configuration, to retain the elongated members in the spiral unit, by:

the housing comprising a housing sleeve connected to a securement region of the spiral and a first tensioner threadably connected to said first end, the first tensioner being rotatable on the first end while abutting against the housing sleeve, to pull the spiral coils of the first end axially away from the housing sleeve and the securement region; and by the connector further comprising a second tensioner abutting against the housing sleeve and threadably rotatable on said second end to pull the spiral coils of the second end axially away from the housing sleeve and the securement region.

* * * * *